US011974616B2

(12) United States Patent
Yanagisawa et al.

(10) Patent No.: US 11,974,616 B2
(45) Date of Patent: May 7, 2024

(54) WEARABLE AIRBAG DEVICE

(71) Applicant: TOYODA GOSEI CO., LTD., Kiyosu (JP)

(72) Inventors: Toshihito Yanagisawa, Kiyosu (JP); Wataru Miura, Kiyosu (JP); Yusuke Kawamura, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 17/467,900

(22) Filed: Sep. 7, 2021

(65) Prior Publication Data

US 2022/0095711 A1 Mar. 31, 2022

(30) Foreign Application Priority Data

Sep. 30, 2020 (JP) ..... 2020-165664
Sep. 30, 2020 (JP) ..... 2020-165665

(51) Int. Cl.
*A41D 13/018* (2006.01)
*A41D 13/05* (2006.01)
(Continued)

(52) U.S. Cl.
CPC ..... *A41D 13/018* (2013.01); *A41D 13/0506* (2013.01); *A41D 13/002* (2013.01); *A41D 13/0155* (2013.01); *A63B 29/021* (2013.01)

(58) Field of Classification Search
CPC ..... A41D 13/0506; A41D 13/018; A41D 13/002; A41D 13/0155; A63B 29/021
See application file for complete search history.

(56) References Cited

U.S. PATENT DOCUMENTS 4,626,221 A * 12/1986 Rocco ..... B63C 9/155 441/108
4,737,994 A * 4/1988 Galton ..... A41D 13/0506 2/DIG. 3
(Continued)

FOREIGN PATENT DOCUMENTS

CN 211048465 U 7/2020
JP 2014-514462 A 6/2014
(Continued)

OTHER PUBLICATIONS

Office Action dated May 30, 2023 in corresponding Japanese Patent Application No. 2020-165664 (and English machine translation).
(Continued)

*Primary Examiner* — Megan E Lynch
*Assistant Examiner* — Giao Q T Hoang
(74) *Attorney, Agent, or Firm* — POSZ LAW GROUP, PLC

(57) ABSTRACT

A wearable airbag device for protecting the hip of a wearer includes an airbag adapted to be worn around the pelvis and inflatable with an inflation gas. The airbag includes: an inner wall configured to face the wearer at airbag deployment; an outer wall opposite the inner wall and having a circumferential edge jointed with that of the inner wall so that the airbag has a substantially board shape when inflated; a contact portion disposed in an upper reach of a stream of inflation gas and configured to be deployed at a side of the pelvis; a protecting portion configured to be deployed in such a manner as to extend downward from the contact portion for covering an outer side of the trochanter of femur at airbag deployment; and a float-preventing means for preventing the protecting portion from floating away from the body of the wearer at airbag deployment.

8 Claims, 27 Drawing Sheets

(51) Int. Cl.

| | |
|---|---|
| *A41D 13/002* | (2006.01) |
| *A41D 13/015* | (2006.01) |
| *A63B 29/02* | (2006.01) |

(56) References Cited

U.S. PATENT DOCUMENTS

| | | | | |
|---|---|---|---|---|
| 5,500,952 | A * | 3/1996 | Keyes | A41D 13/018 2/908 |
| 8,998,667 | B2 * | 4/2015 | Malcom | B63C 9/155 441/92 |
| 10,238,918 | B1 * | 3/2019 | Huot | A45F 3/04 |
| 2007/0117479 | A1 * | 5/2007 | Weinel | A62B 33/00 441/117 |
| 2014/0047624 | A1 * | 2/2014 | Richards | A41D 13/0155 2/455 |
| 2015/0101112 | A1 * | 4/2015 | Balbien | A41D 13/018 2/455 |
| 2017/0158155 | A1 | 6/2017 | Ohno et al. | |
| 2017/0224031 | A1 | 8/2017 | Raanan | |

FOREIGN PATENT DOCUMENTS

| | | | |
|---|---|---|---|
| JP | 2017-100688 | A | 6/2017 |
| JP | 2019-81457 | A | 5/2019 |
| WO | 2019/207474 | A | 10/2019 |

OTHER PUBLICATIONS

Office Action dated May 30, 2023 in corresponding Japanese Patent Application No. 2020-165665 (and English machine translation).

* cited by examiner

WEARABLE AIRBAG DEVICE

CROSS REFERENCE TO RELATED APPLICATIONS

The present application claims priority from Japanese Patent Application No. 2020-165664 of Yanagisawa et al., filed on Sep. 30, 2020, and Japanese Patent Application No. 2020-165665 of Yanagisawa et al., filed on Sep. 30, 2020, the entire disclosures of which are incorporated herein by reference.

BACKGROUND

1. Technical Field

The present disclosure relates to a wearable airbag device for protecting the hip of a wearer.

2. Description of Related Art

WO 2019/207474 A1 discloses a wearable airbag device for protecting the hip of a wearer such as an elderly person in the event of a fall or the like. This airbag device is designed to be wrapped around the waist of the wearer so as to inflate and deploy an airbag downward for protecting his hip when activated.

An airbag configured to be inflated with an inflation gas is usually inflated thick in such a manner that both outer surfaces thereof curve. Accordingly, when the airbag of the above reference is inflated and deployed downward from the state mounted around the waist, there may be a fear that the airbag as inflated floats away from the hip and fails to cover the hip quickly and adequately in the event of a fall or the like.

SUMMARY

An exemplary embodiment in the present disclosure relates to a wearable airbag device adapted to be worn by a wearer for protecting the hip of the wearer, the airbag device including an airbag that is adapted to be put on a circumference of the pelvis of the wearer and configured to be inflated with an inflation gas. The airbag includes: an inner wall that is configured to face the wearer at airbag deployment, the inner wall having a circumferential edge; an outer wall that is configured to face away from the wearer at airbag deployment, the outer wall having a circumferential edge jointed with the circumferential edge of the inner wall so that the airbag has a substantially board shape when inflated; a contact portion that is disposed in an upper reach of a stream of the inflation gas and is configured to be deployed at least at a side of the pelvis at airbag deployment; at least one protecting portion that is configured to be deployed in such a manner as to extend downward from the contact portion for covering an outer side of the trochanter of femur of the wearer at airbag deployment; and a float-preventing means that is configured to prevent the protecting portion from floating away from the body of the wearer at airbag deployment.

Another exemplary embodiment in the present disclosure relates to a wearable airbag device adapted to be worn by a wearer for protecting the hip of the wearer, the airbag device including a gas generator; and an airbag that is adapted to be put on a circumference of the pelvis of the wearer and configured to be inflated with an inflation gas fed from the gas generator. The airbag includes: an inner wall that is configured to face the wearer at airbag deployment, the inner wall having a circumferential edge; an outer wall that is configured to face away from the wearer at airbag deployment, the outer wall having a circumferential edge jointed with the circumferential edge of the inner wall so that the airbag has a substantially board shape when inflated; an applying portion that is disposed in a vicinity of an upper end of the airbag and adapted to be applied to the circumference of the pelvis; two protecting portions each of which is configured to cover an outer side of the trochanter of femur of the wearer; a gas-feeding path that is connected with the gas generator and adapted to be disposed at the back of the pelvis; and two gas channels each of which provides gas communication between the gas-feeding path and each of the protecting portions, each of the gas channels extending downwardly and outwardly in a left and right direction from the gas-feeding path, then turning upward at a position beneath the protecting portion and communicating with the protecting portion by a leading end thereof.

Yet another exemplary embodiment in the present disclosure relates to a wearable airbag device adapted to be worn by a wearer for protecting the hip of the wearer, the airbag device including an airbag that is adapted to be put on a circumference of the pelvis of the wearer and configured to be inflated with an inflation gas. The airbag includes: an inner wall that is configured to face the wearer at airbag deployment, the inner wall having a circumferential edge; an outer wall that is configured to face away from the wearer at airbag deployment, the outer wall having a circumferential edge jointed with the circumferential edge of the inner wall so that the airbag has a substantially board shape when inflated; a contact portion that is disposed in a vicinity of an upper end of the airbag as deployed and configured to be deployed at least at a side of the pelvis; and at least one protecting portion that is configured to be deployed in such a manner as to extend downward from the contact portion for covering an outer side of the trochanter of femur of the wearer at airbag deployment. The airbag has a folded form that has a reduced width in an up and down direction compared to that of the airbag in an unfolded state in which the inner wall and outer wall are laid flat one over another. The folded form of the airbag is so configured as to allow the contact portion to be inflated prior to the protecting portion, and push and deploy the protecting portion downward in an initial stage of airbag deployment.

BRIEF DESCRIPTION OF DRAWINGS

FIG. 6 is a schematic horizontal sectional view of a left portion of the airbag.

FIG. 24 is a schematic horizontal sectional view of a left portion of the airbag.

DETAILED DESCRIPTION

Exemplary embodiments of the present disclosure are described below with reference to the accompanying drawings. However, the invention is not limited to the embodiments disclosed herein. All modifications within the appended claims and equivalents relative thereto are intended to be encompassed in the scope of the claims.

Figure 1:
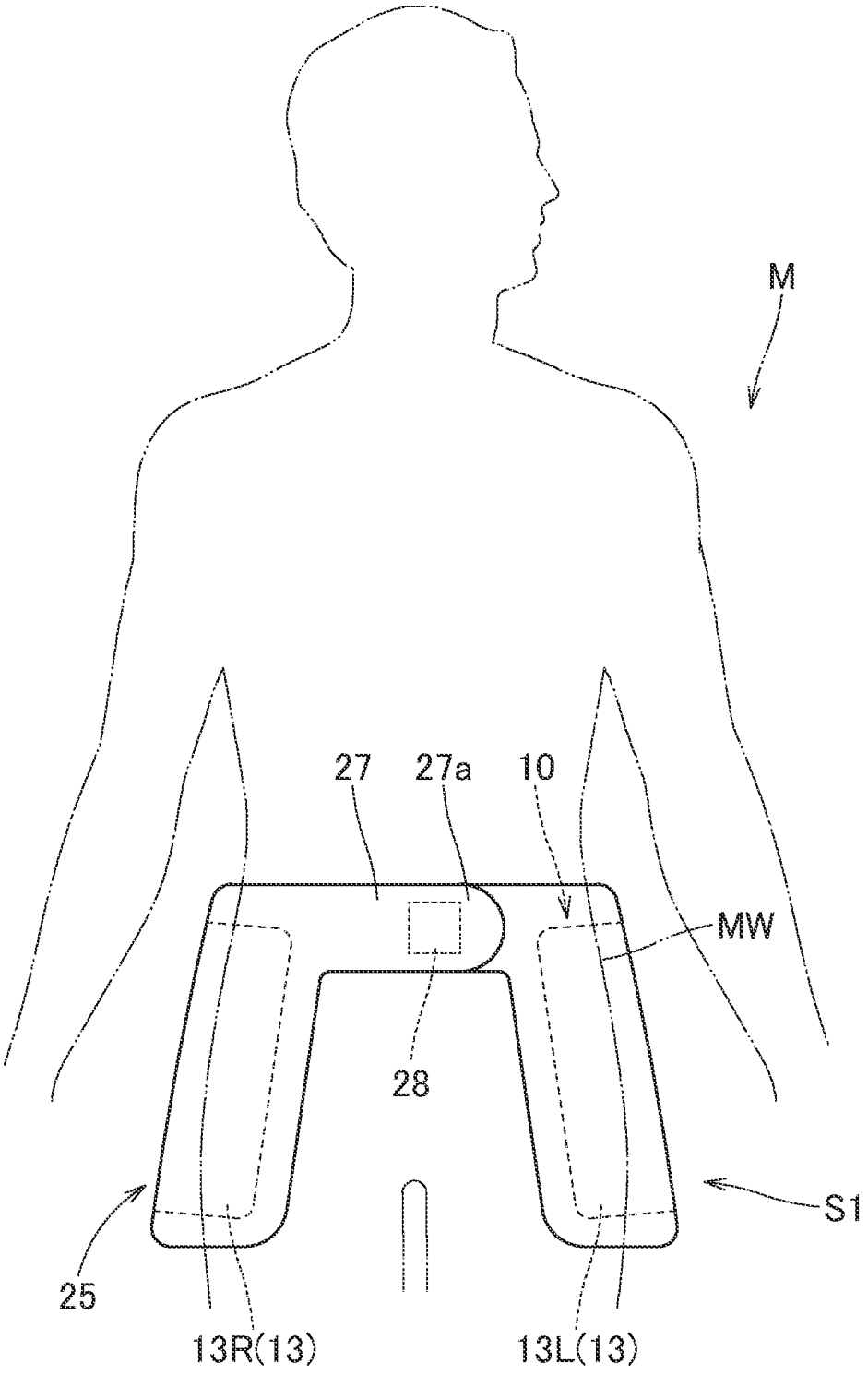
FIG. 1 schematically depicts a wearable airbag device in accordance with a first exemplary embodiment as worn by a wearer.

A wearable airbag device S1 in accordance with the first exemplary embodiment is configured to be wrapped around the hip MW (more particularly, around the pelvis MP) of a wearer M, as can be seen in FIG. 1. Unless otherwise specified, up-down, front-rear, and left-right directions in this exemplary embodiment are intended to refer to up-down, front-rear, and left-right directions as viewed from the wearer M wearing the airbag device S1.

Figure 2:
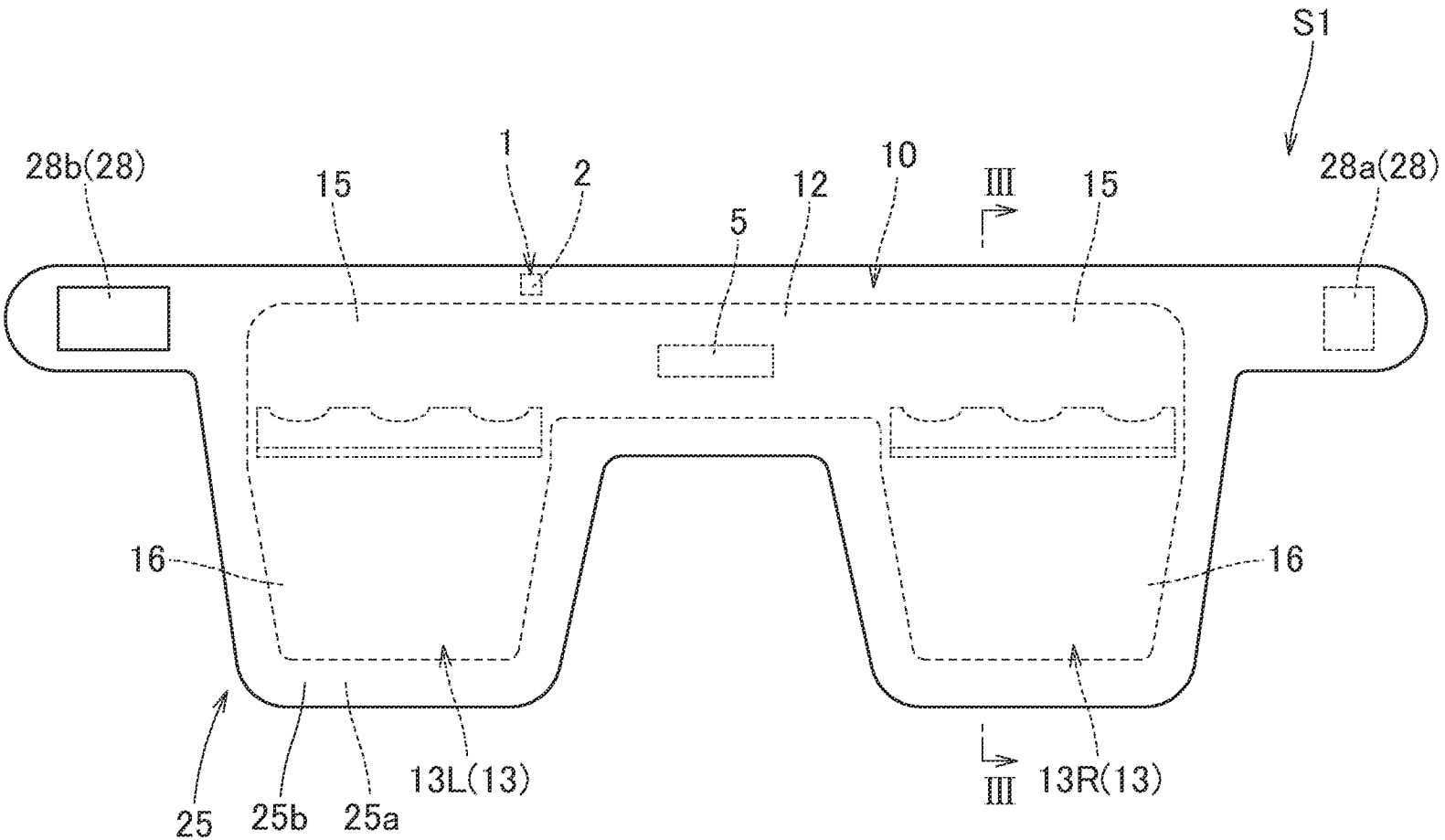
FIG. 2 is a plan view of the wearable airbag device of the first exemplary embodiment as laid flat.
Figure 3:
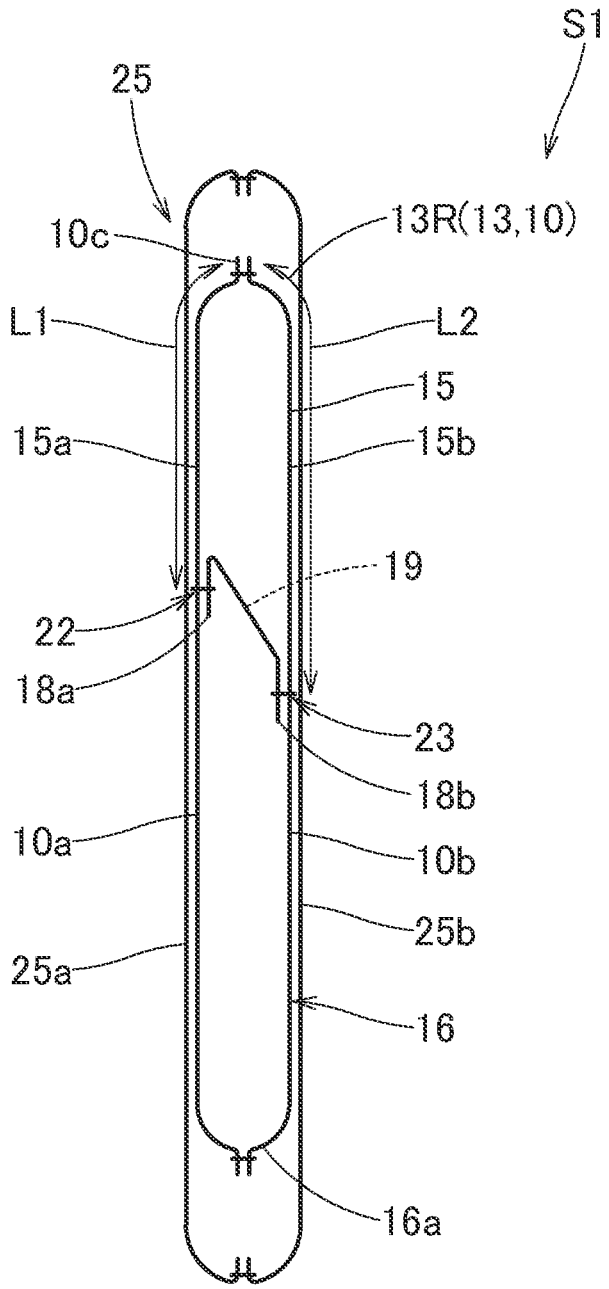
FIG. 3 is a schematic vertical sectional view of the wearable airbag device of the first exemplary embodiment taken along line of FIG. 2.

As can be seen in FIGS. 1 to 3, the wearable airbag device S1 includes an airbag 10, a gas generator 5 for feeding the airbag 10 with an inflation gas, an operation control device 1 that includes a sensor part 2 for detecting a fall of the wearer M and is configured to actuate the gas generator 5, and an outer cover 25 that covers an outer circumference of the airbag 10. In the wearable airbag device S1 in accordance with the first exemplary embodiment, the airbag 10 is disposed inside the outer cover 25 in a developed or unfolded state, as can be seen in FIGS. 2 and 3.

The operation control device 1 includes a sensor part 2 that includes an angular velocity sensor capable of sensing angular velocities around three axes in up and down, front and rear, and left and right directions, and an acceleration sensor capable of sensing accelerations in the three-axis directions. The operation control device 1 is configured to actuate the gas generator 5 in response to a signal fed from the sensor part 2 as has sensed a falling behavior different from a normal behavior of the wearer M. More particularly, the operation control device 1 includes a determining means that is configured to determine based on various thresholds, and is configured to actuate the gas generator 5 upon sensing a fall of the wearer M based on the determination by the determining means. The operation control device 1 further includes a power source composed of a not-shown battery or the like for operation of the sensor part 2 and for emission of an actuating signal to the gas generator 5.

Figure 4:
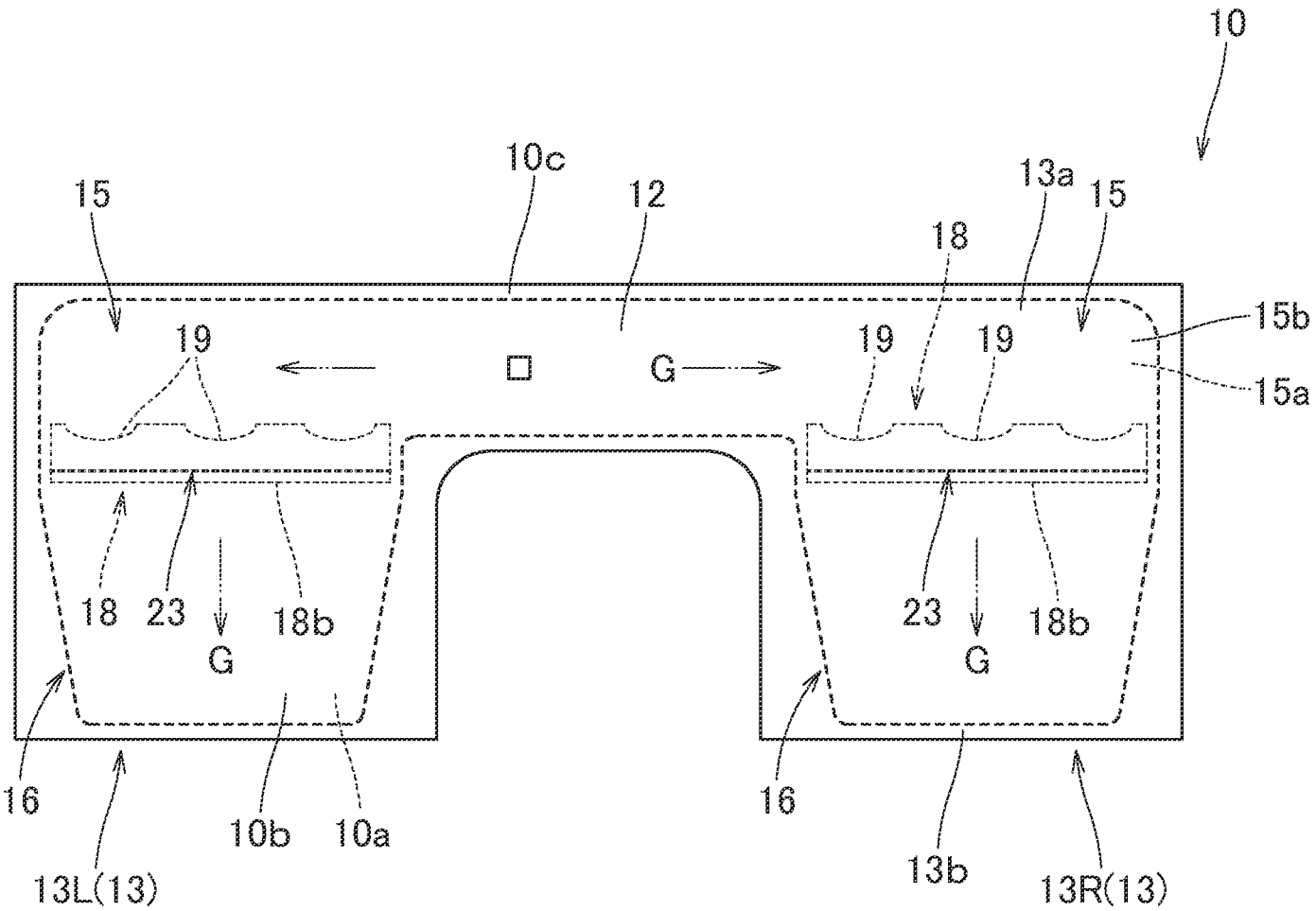
FIG. 4 is a plan view of an airbag for use in the wearable airbag device of the first exemplary embodiment as laid flat.

The airbag 10 is made of a sheet material having flexibility. The airbag 10 of this specific embodiment is made of a fabric woven with polyester yarns, polyimide yarns or the like. The airbag 10 is adapted to be wrapped around the pelvis MP of the wearer M through the use of a later-described belt 27 of the outer cover 25. In this embodiment, the airbag 10 is configured to be disposed on left and right sides of the hip MW of the wearer M when worn, as can be seen in FIG. 1. Referring to FIGS. 3 and 4, the airbag 10 includes an inner wall 10*a* that is disposed towards the wearer M (i.e. in the inner side) when worn, and an outer wall 10*b* that is disposed on the outer side when worn. The inner wall 10*a* and outer wall 10*b* are substantially identical in outer shape. The airbag 10 is formed by sewing (or jointing) circumferential edges of the inner wall 10*a* and outer wall 10*b* together into a bag, thus is configured to be inflated into a substantially board shape. As shown in FIG. 4, the airbag 10 of this embodiment includes two bag bodies 13 (13L, 13R) that are adapted to be disposed on the left and right sides of the hip MW of the wearer M, respectively, and a gas-feeding path 12 that provides gas communication between the bag bodies 13 (13L, 13R) at a vicinity of the upper ends 13*a* of the bag bodies 13. The airbag 10 as laid flat is bilaterally symmetrical.

The gas-feeding path 12 is designed to be inflated into a rod shape elongated substantially along a left and right direction. The gas-feeding path 12 of this embodiment is adapted to be deployed at the rear of the pelvis MP of the wearer M though not depicted in detail. In this embodiment, the gas generator 5 is connected to the gas-feeding path 12 for feeding the airbag 10 with an inflation gas (FIG. 2). Although not depicted in detail, the gas generator 5 is disposed in a vicinity of the center in the length direction of the gas-feeding path 12. The gas generator 5 contains a compressed gas, and is designed to discharge a cold gas into the airbag 10 when actuated and unsealed. The gas generator 5 is electrically connected with the operation control device 1 and configured to be actuated when fed with an actuating signal from the operation control device 1 as has sensed a fall of the wearer M.

Referring to FIG. 4, each of the bag bodies 13 (13L, 13R) of this embodiment includes a contact portion 15 and a protecting portion 16 that extends downward from the contact portion 15.

The contact portion 15 of this embodiment is a portion continuous with the gas-feeding path 12 and disposed on extensions to the left and right of the gas-feeding path 12 in the airbag 10 as laid flat. The contact portion 15 is disposed in an upper end 13*a* portion of the bag body 13. i.e. in an upper reach of a stream of the inflation gas G.

Figure 7:
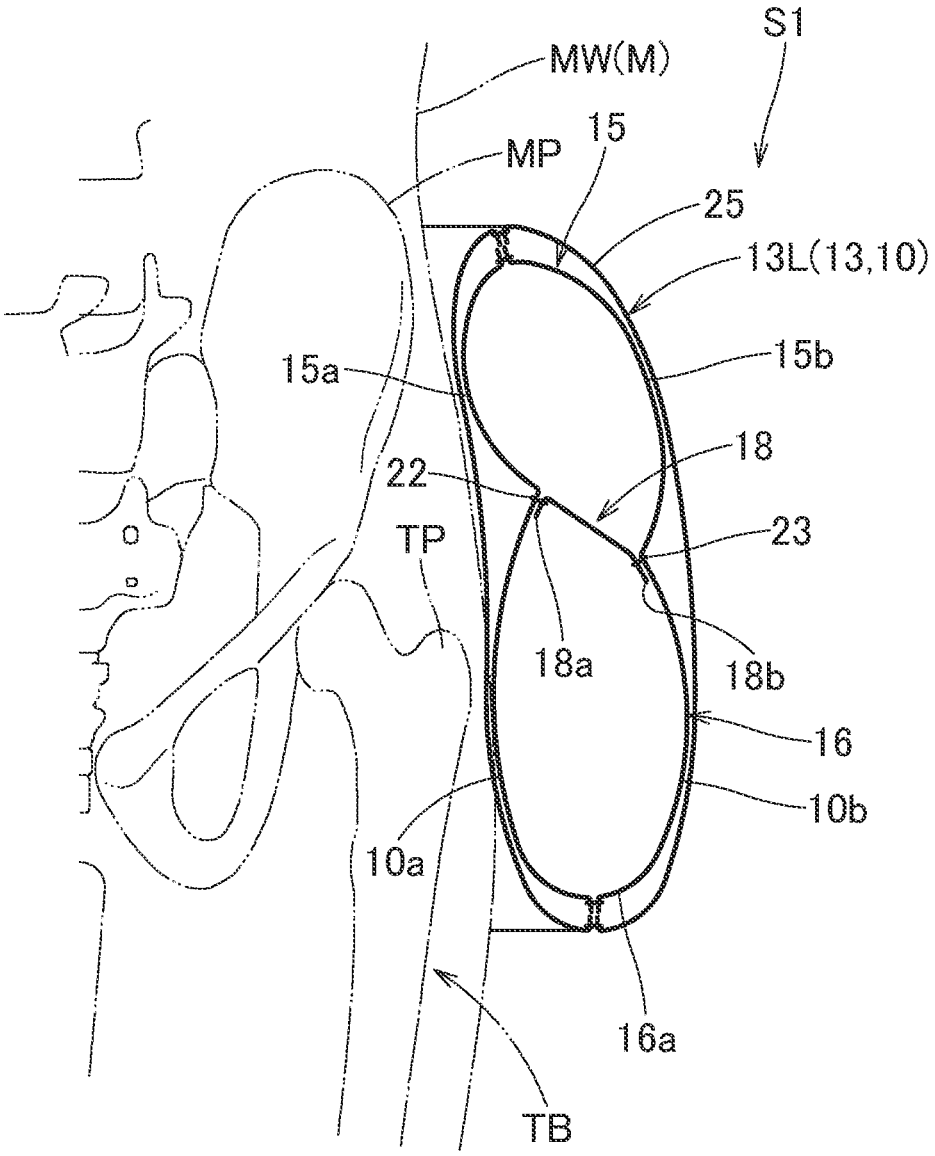
FIG. 7 is a schematic vertical sectional view of the airbag as deployed in a worn state, in the wearable airbag device of the first exemplary embodiment.

The contact portion 15 is a portion applied to the circumference of the hip MW of the wearer M with the use of a later-described belt 27 of the outer cover 25. The contact portion 15 is designed to be deployed on a side of the pelvis MP of the wearer M at airbag deployment, as can be seen in FIG. 7. The contact portion 15 of this specific embodiment is intended to refer to a portion that is disposed substantially in an entirety in the left and right direction of an upper edge 10*c* region of the airbag 10 as laid flat, including the gas-feeding path 12.

Figure 6:
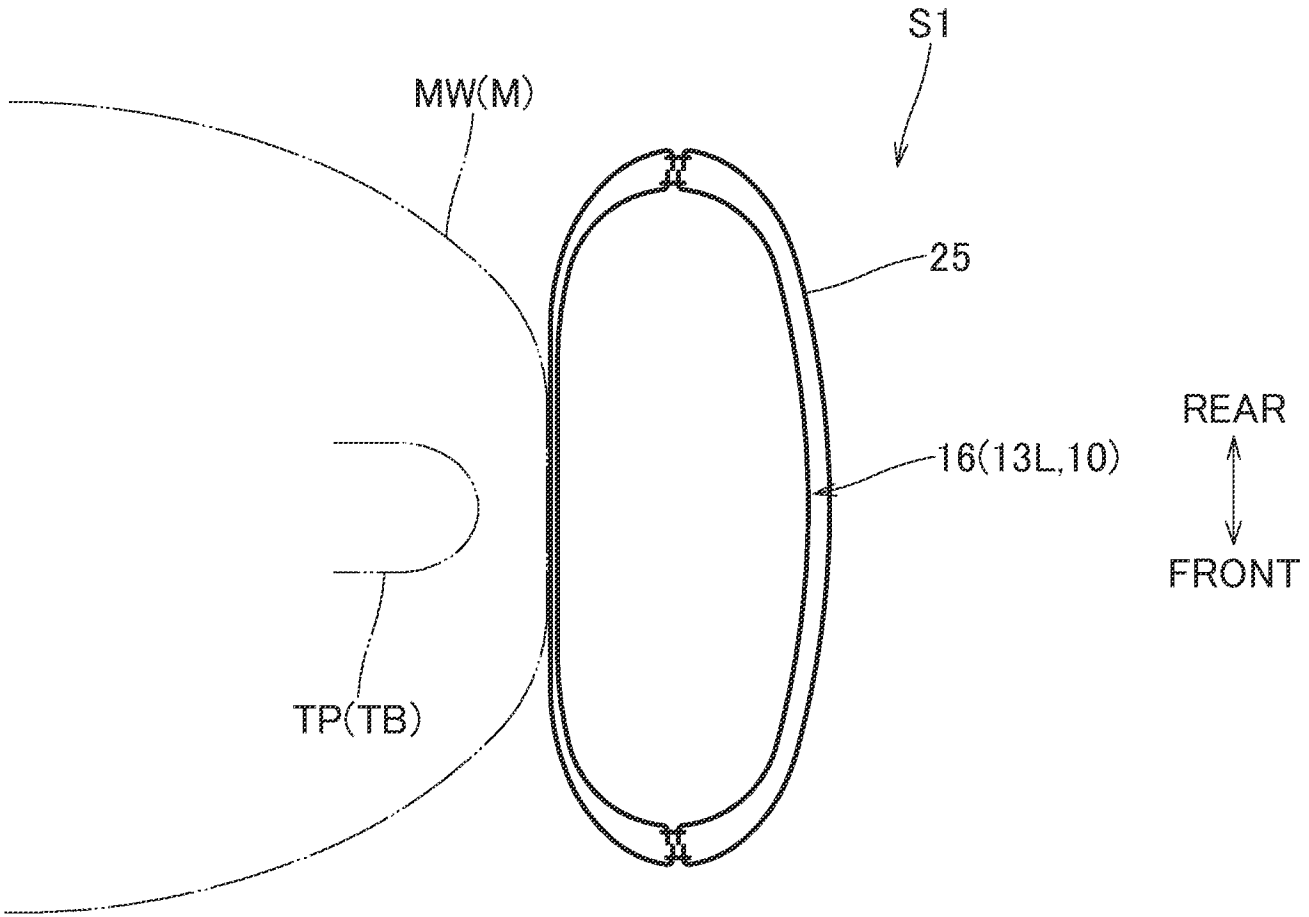
FIG. 6 is a schematic partial horizontal sectional view of the airbag as deployed taken along a front and rear direction in the wearable airbag device of the first exemplary embodiment. More particularly.

The protecting portion 16 is designed to extend downward from the contact portion 15, and disposed in a lower end 13*b* portion of the bag body 13. The protecting portion 16 is designed to cover an outer side of the trochanter TP of femur as the object of protection at airbag deployment. In this embodiment, in order to cover the trochanter TP of femur amply, the protecting portion 16 as laid flat has a substantially trapezoidal outer shape that has a greater width in the left and right direction than that in the up and down direction, and slightly narrows toward the lower end 16*a*. The width in the left and right direction of the protecting portion 16 is substantially identical to that of the contact portion 15. As can be seen in FIGS. 6 and 7, the protecting portion 16 is designed to cover the outer side of the trochanter TP of femur amply both in the front and rear direction and in the up and down direction at airbag deployment.

In each of the bag bodies 13 (13L, 13R) of the airbag 10, the contact portion 15 and the protecting portion 16 are partitioned by a tether 18. In this embodiment, the tether 18 is arranged in such a manner as to block substantially an entirety of a passage between the contact portion 15 and protecting portion 16. The tether 18 is designed to regulate a clearance between the inner wall 10*a* and the outer wall 10*b* at airbag deployment. The tether 18 is formed into a band whose length is slightly shorter than a width in the left and right direction of the bag body 13. An inner edge 18*a* of the tether 18 is jointed to the inner wall 10*a* by an inner joint 22 and an outer edge 18*b*, which is opposite from the inner edge 18*a*, is jointed to the outer wall 10*b* by an outer joint 23, as can be seen in FIGS. 3 and 4. The tether 18 is provided with a plurality of (three, in this embodiment) communication holes 19 that are configured to let an inflation gas as has flown into the contact portion 15 out into the protecting portion 16. The communication holes 19 are arranged along the length direction of the tether 18. The tether 18 constitutes a float-preventing means. As can be seen in FIG. 3, in the airbag 10 as laid flat, the inner joint 22 that connects the inner edge 18*a* of the tether 18 to the inner wall 10*a* is disposed at a higher position than the outer joint 23 that connects the outer edge 18*b* to the outer wall 18*b*. That is, in the airbag 10 of this embodiment, the contact portion 15 is designed such that a film length L1 in the up and down direction of the inner wall 15*a* to face the wearer M (in other words, a film length L1 of the inner wall 15*a* from the upper edge 10*c* to the inner joint 22) is shorter than a film length L2 in the up and down direction of the outer wall 15*b* to face outward (in other words, a film length L2 of the outer wall 15*b* from the upper edge 10*c* to the outer joint 23), as shown in FIG. 3. As can be seen in FIG. 4, each of the inner joint 23 and outer joint 23 continuously sews a substantially entire length of the inner edge 18*a*/outer edge 18*b* of the tether 18 to the inner wall 10*a*/outer wall 10*b* with sewing threads.

The outer cover 25 is made of a flexible fabric having better touch than the base cloth of the airbag 10. The outer cover 25 covers an entirety of the outer circumference of the airbag 10. The outer cover 25 includes an inner wall 25*a* that is disposed towards the wearer M (i.e. in the inner side) when worn, and an outer wall 25*b* that is disposed on the outer side when worn, and is formed by jointing (or sewing) circumferential edges of the inner wall 25*a* and outer wall 25*b* together. An outer shape of the outer cover 25 as laid flat is greater than the airbag 10 as laid flat so as to allow the airbag 10 to inflate smoothly inside the outer cover 25, as can be seen in FIGS. 2 and 3. The outer cover 25 includes a pair of belts 27 that protrude outwardly toward the left and right in a vicinity of the upper edge. The belts 27 include a fastening means at the leading ends 27*a*. The fastening means in this embodiment is composed of a hook-and-loop fastener 28 including hooks 28*a* and loops 28*b* engageable with one another so as to enable the wearer M to wear the airbag device S1 easily according to the size of the waist.

Figure 5:
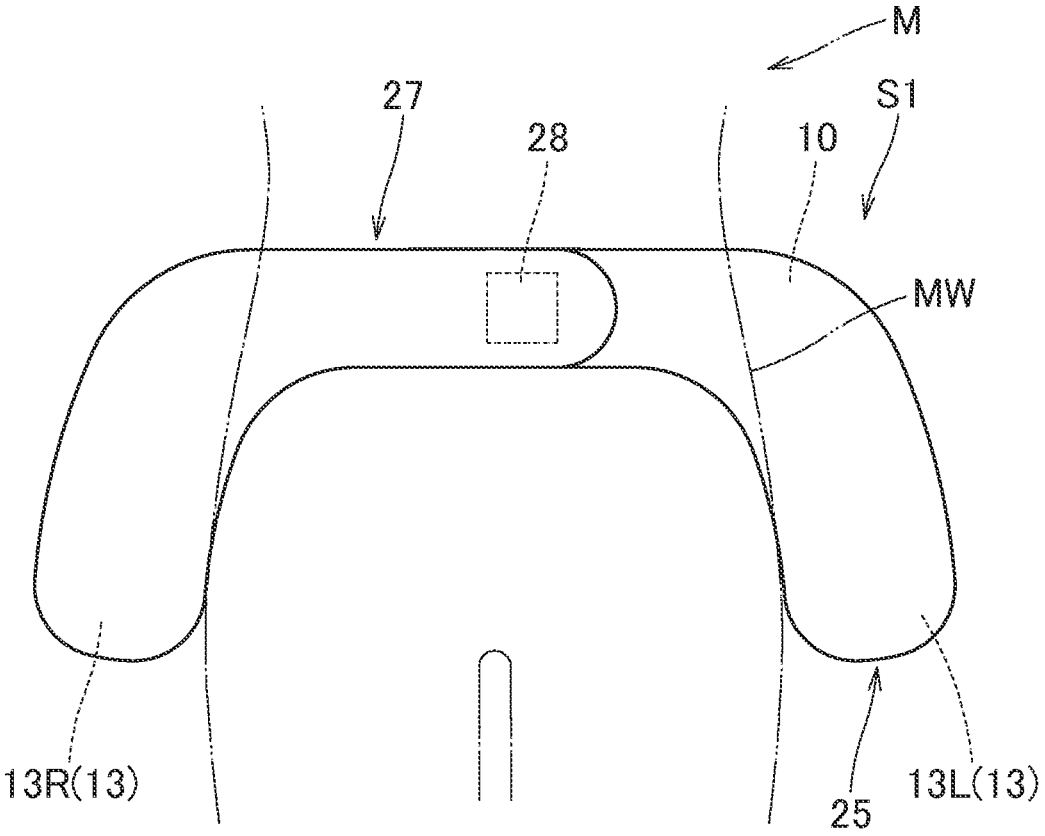
FIG. 5 schematically depicts the wearable airbag device of the first exemplary embodiment as worn by the wearer at airbag deployment.

The wearable airbag device S1 in accordance with the first exemplary embodiment is put on around the hip MW (pelvis MP) of the wearer M in a wrapping manner by fastening the leading ends 27*a* of the belts 27 together with the use of the hook-and-loop fastener 28 (as the fastening means). If the sensor part 2 detects a falling behavior of the wearer M as wearing the airbag device S1, the operation control device 1 sends an actuating signal to the gas generator 5, the gas generator 5 feeds an inflation gas to the airbag 10, so that the airbag 10 is deployed as shown in FIGS. 5 to 7.

In the wearable airbag device S1 in accordance with the first exemplary embodiment, although each of the protecting portions 16 for covering an outer side of the trochanter TP of femur (i.e. the object of protection) is configured to be deployed in such a manner as to extend downward from the contact portion 15 disposed at a side of the pelvis MP, the tether 18 serving as the float-preventing means will prevent the protecting portion 16 from floating away from the hip MW, in other words, help deploy the protecting portion 16 in proximity to the object of protection (i.e. the trochanter TP of femur), as can be seen in FIG. 7. Therefore, the protecting portions 16 are able to cover outer sides of the trochanters TP of femurs as the object of protection quickly and adequately.

Therefore, the wearable airbag device S1 in accordance with the first exemplary embodiment is able to protect the hip MW of the wearer M in a steady fashion.

In the wearable airbag device S1 in accordance with the first exemplary embodiment, the airbag 10 (more particularly, the bag body 13) includes, as the float-preventing means, the tether 18 that connects the inner wall 10*a* and the outer wall 10*b* at a vicinity of the border between the contact portion 15 and the protecting portion 16 inside the bag body 13. The tether 18 will suppress the airbag 10 or bag body 13 from being inflated too thick. Further, the tether 18 is arranged such that the inner joint 22 that connects the inner edge 18*a* of the tether 18 to the inner wall 10*a* is disposed at a higher position than the outer joint 23 that connects the outer edge 18*b* of the tether 18 to the outer wall 10*b*. In other words, the tether 18 makes the substantial film length L1 of the inner wall 15*a* of the contact portion 15 shorter than the substantial film length L2 of the outer wall 15*b* of the contact portion 15. This configuration will help bend the airbag 10 (or bag body 13) at the inner joint 22 at airbag deployment so that the lower end 16*a* the protecting portion 16 is directed inward, i.e. toward the wearer M, as can be seen in FIG. 7, thus prevent the protecting portion 16 from floating away from the hip MW of the wearer M adequately. Therefore, the protecting portion 16 is able to cover the outer side of the trochanter TP of femur as the object of protection adequately.

Figure 8:
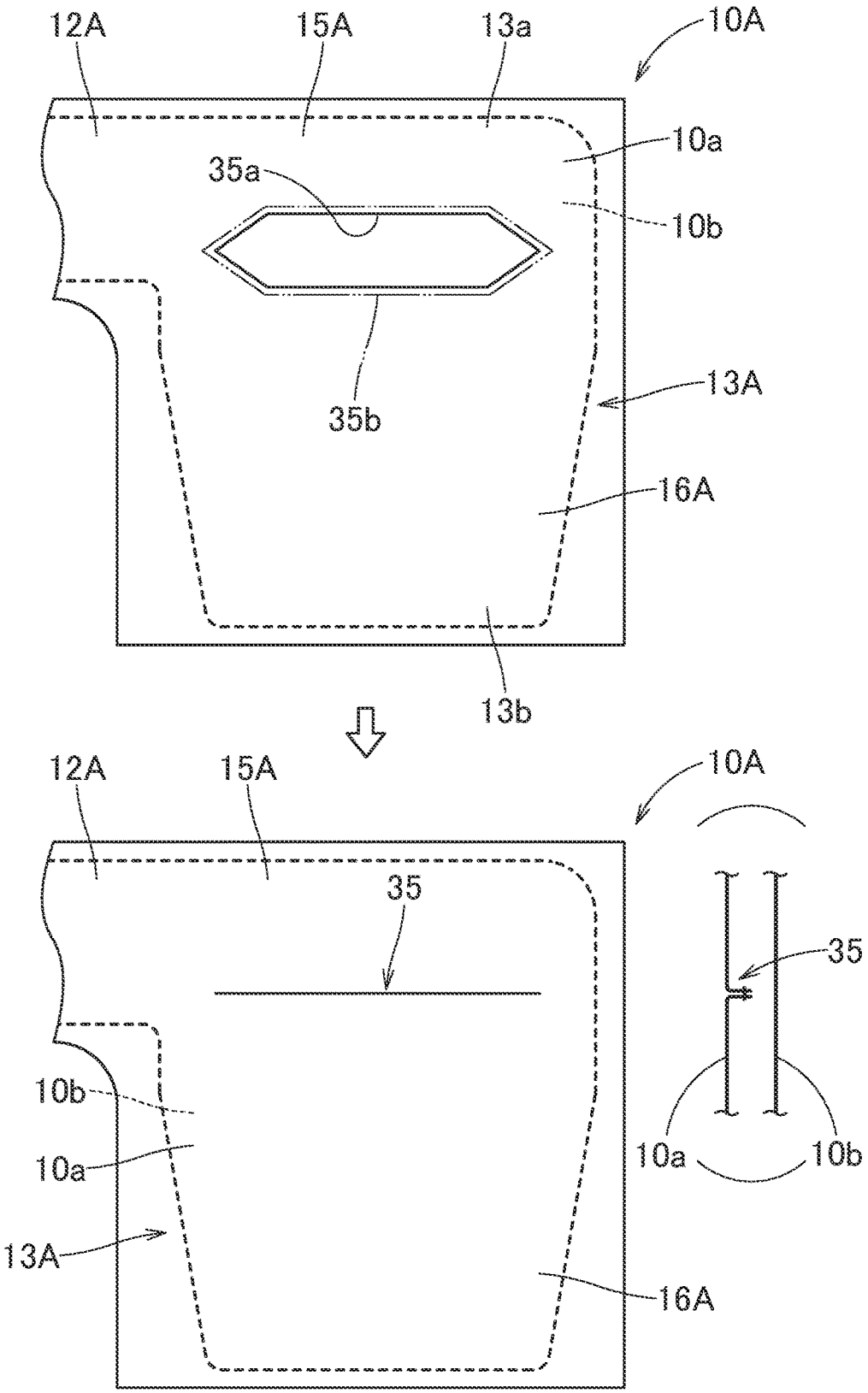
FIG. 8 is a partial enlarged plan view of a modification of the airbag.
Figure 9:
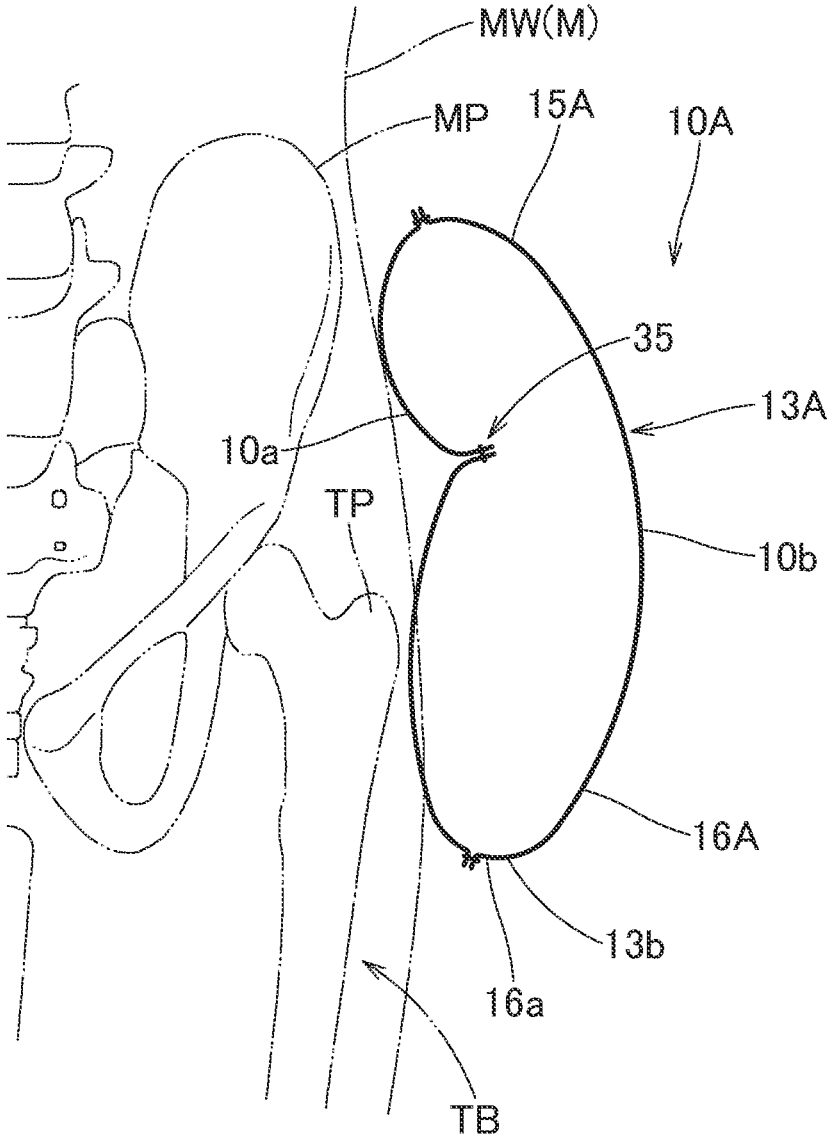
FIG. 9 is a schematic vertical sectional view of the airbag of FIG. 8 as deployed.

The airbag may be configured like an airbag 10A depicted in FIGS. 8 and 9. The airbag 10A includes, instead of the tether 18, a tuck 35 in the inner wall 10*a* of the bag body 13A, as the float-preventing means. The tuck 35 makes a film length in the up and down direction of the inner wall 10*a* shorter than that of the outer wall 10*b*. The tuck 35 is disposed in a region of the contact portion 15A in the inner wall 10*a*. More specifically, referring to FIG. 8, the inner wall 10*a* prior to being formed into the airbag 10A was provided, slightly above the lower edge of and at a side of the gas-feeding path 12A, with a cut-out portion 35*a* elongated in the left and right direction. The tuck 35 of this specific embodiment is composed of a seam 35*b* that joints peripheral edges of the cut-out portion 35*a* together. That is, the tuck 35 has an elongated shape substantially in the left and right direction. The outer wall 10*b* and the inner wall 10*a* before formation of the tuck 35 are substantially identical in outer shape.

With the airbag 10A (or bag body 13A) configured as described above, the tuck 35 makes a film length in the up and down direction of the inner wall 10*a* shorter than that of the outer wall 10*b*, thus will help bend the inner wall 10*a* at the tuck 35 (FIG. 9), and deploy the bag body 13A so that the lower end 13*b* portion (in other words, the lower end 16*a* portion of the protecting portion 16A) is directed toward the wearer M (i.e. inward). Further, since the tuck 35 is formed in the region of the contact portion 15A which is disposed in an upper portion of the bag body 13A, the tuck 35 will help bend the bag body 13A at the tuck 35 so that a substantially entirety in the up and down direction of the protecting portion 16A deploys in proximity to the wearer M, thus prevent the protecting portion 16A from being separated from the object of protection (i.e. the trochanter TP of femur) adequately, so that the protecting portion 16A will cover an outer side of the object of protection (i.e. the trochanter TP of femur) adequately as can be seen in FIG. 9. The outer cover is omitted in FIG. 9.

Figure 10:
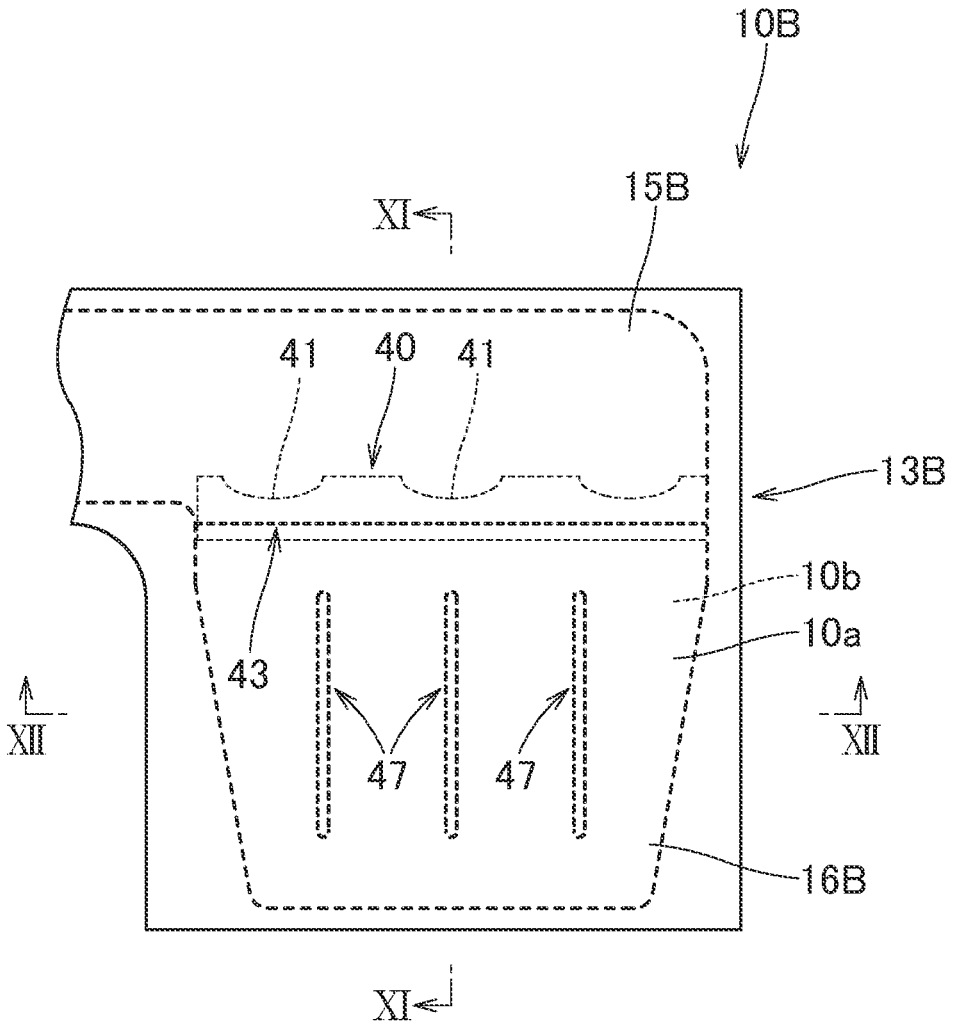
FIG. 10 is a partial enlarged plan view of another modification of the airbag.
Figure 11:
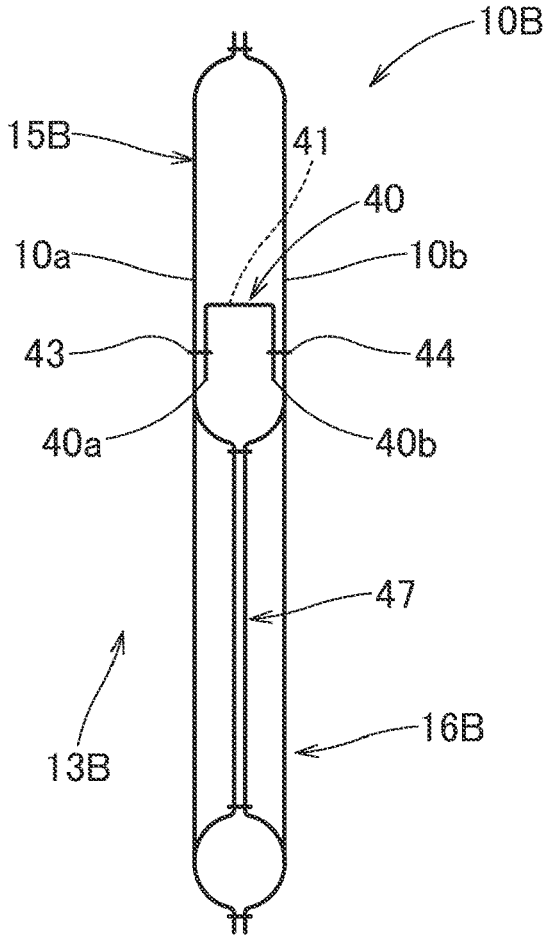
FIG. 11 is a schematic vertical sectional view of the airbag of FIG. 10 taken along line XI-XI of FIG. 10.
Figure 12:
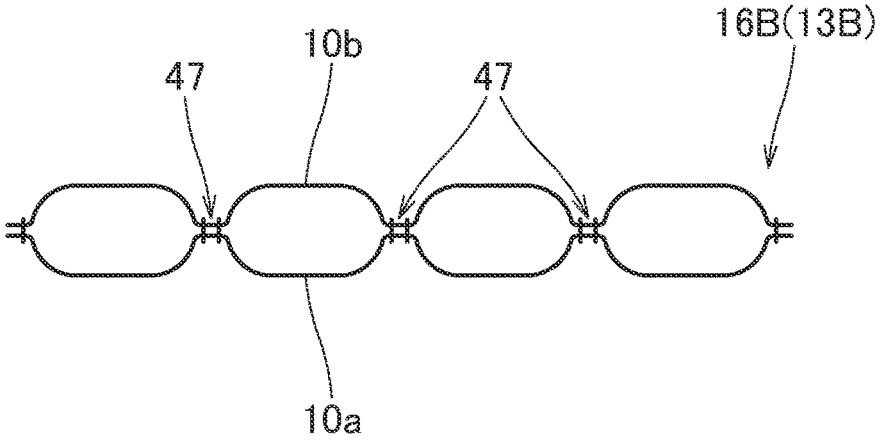
FIG. 12 is a schematic horizontal sectional view of the airbag of FIG. 10 taken along line XII-XII of FIG. 10.
Figure 13:
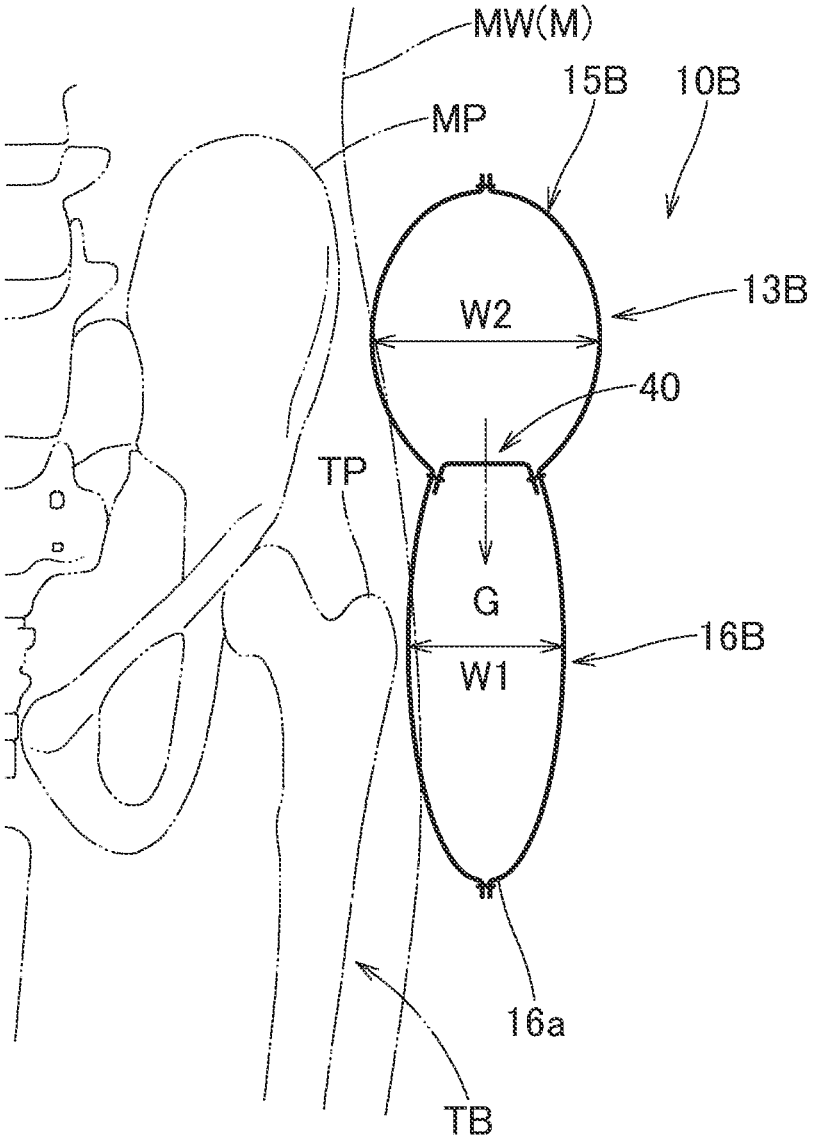
FIG. 13 is a schematic vertical sectional view of the airbag of FIG. 10 as deployed in a worn state.

The airbag may be configured like an airbag 10B depicted in FIGS. 10 to 13. The airbag 10B includes, inside the bag body 13B, a bulkhead 40 that partitions the contact portion 15B from the protecting portion 16B. Further, the airbag 10B is designed such that the protecting portion 16B is thinner than the contact portion 15B when inflated. More specifically, the bulkhead 40 is arranged in such a manner as to block substantially an entirety of a passage between the contact portion 15B and protecting portion 16B. The bulkhead 40 is formed into a band whose length is substantially the same as the width in a left and right direction of the bag body 13B. An inner edge 40*a* of the bulkhead 40 is jointed to the inner wall 10*a* by an inner joint 43 and an outer edge 40*b*, which is opposite from the inner edge 40*a*, is jointed to the outer wall 10*b* by an outer joint 44, as can be seen in FIG. 10. The positions of the inner joint 43 and outer joint 44 in an up and down direction are substantially coincident, as can be seen in FIG. 11. That is, the bulkhead 40 is arranged substantially horizontally at airbag deployment, as can be seen in FIG. 13. The bulkhead 40 is provided with a plurality of (three, in this embodiment) communication holes 41 that are configured to let an inflation gas as has flown into the contact portion 15B out into the protecting portion 16B. The communication holes 41 are arranged along the length direction of the bulkhead 40. The airbag 10B (or bag body 13B) further includes, in a region of the protecting portion 16B, at least one (three, in this embodiment) seam 47 that couples the inner wall 10*a* and outer wall 10*b* together directly in order to make the protecting portion 16B as inflated thin. In this specific embodiment, the seams 47 are each formed into a straight line extending substantially along the up and down direction, and disposed side by side in the left and right direction in the bag body 13B as laid flat. In the airbag 10B, the bulkhead 10B and the seams 47 constitute the float-preventing means.

When the airbag 10B (or bag body 13B) configured as described above is deployed, the contact portion 15B will be inflated with an inflation gas first, then the protecting portion 16B will be inflated. The protecting portion 16B will receive an inflation gas G from the contact portion 15B via the communication holes 41 formed in the bulkhead 40 as can be seen in FIG. 13 since the protecting portion 16B and the contact portion 15B are partitioned by the bulkhead 40. Further, the protecting portion 16B is configured to be inflated thinner than the contact portion 15B at airbag deployment. More particularly, the width W1 of the protecting portion 16B as fully inflated is smaller than the width W2 of the contact portion 15B as fully inflated, as can be seen in FIG. 13. The trochanter TP of femur as the object of protection is positioned farther outward in the left and right direction with respect to the center in a horizontal direction of the body of the wearer M compared to the pelvis MR The airbag 10B is designed such that the protecting portion 16B for covering the outer side of the trochanter TP of femur is thinner than the contact portion 15B to be disposed at a side of the pelvis MP at airbag deployment. In other words, the protecting portion 16B is deployed in such a manner as to be recessed relative to the contact portion 15B. With this configuration, the difference in thickness between the contact portion 15B and protecting portion 16B absorbs the protrusion of the trochanter TP of femur from the pelvis MP, so that the protecting portion 16B will be prevented from being deployed in such a manner as to open downward, in other words in such a manner that the lower end 16*a* is separated from the wearer M. Therefore, the protecting portion 16B will be prevented from floating away from the wearer M adequately, thus cover the outer side of the object of protection (i.e. the trochanter TP of femur) adequately. In this embodiment, especially, since the airbag 10B of this embodiment is designed to be put on around the hip MW of the wearer M by the contact portion 15B with the use of the belt of the outer cover (though the outer cover is not depicted in FIG. 13), the protecting portion 16B extending downward from the contact portion 15B would be likely to float away from the wearer M. However, such a floating behavior of the protecting portion 16B will be prevented adequately since the protecting portion 16B is designed to be inflated thinner than the contact portion 15B.

Figure 14:
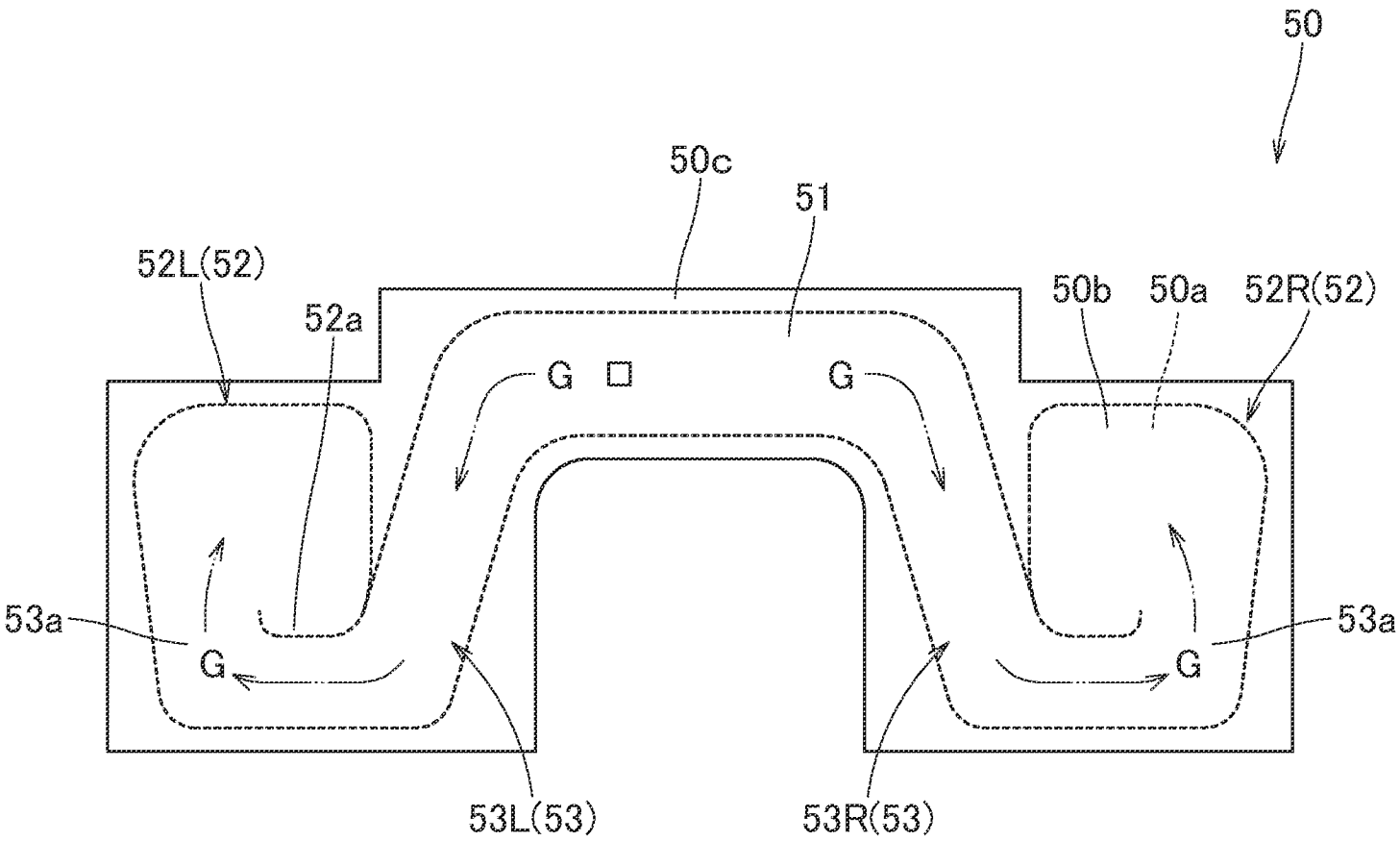
FIG. 14 is a plan view of an airbag for use in a wearable airbag device in accordance with a second exemplary embodiment.
Figure 15:
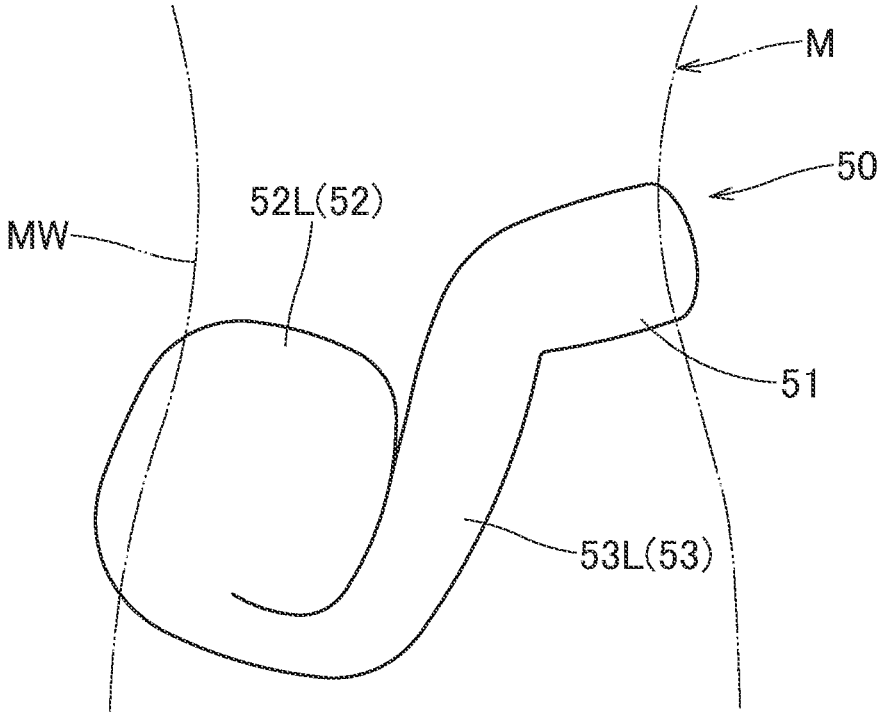
FIG. 15 is a schematic perspective view of the airbag of FIG. 14 as deployed in a worn state.

An airbag 50 for use in a wearable airbag device S2 in accordance with the second exemplary embodiment is now described in reference to FIGS. 14 and 15. The airbag 50 includes an inner wall 50*a* that is disposed towards the wearer M (i.e. in the inner side) when worn, and an outer wall 50*b* that is disposed on the outer side when worn. The inner wall 50*a* and outer wall 50*b* are substantially identical in outer shape. The airbag 50 is formed by sewing (or jointing) circumferential edges of the inner wall 50*a* and outer wall 50*b* together into a bag which is inflatable into a substantially board shape. As can be seen in FIG. 14, the airbag 50 of this embodiment includes two protecting portions 52 (52L, 52R) each of which is configured to cover an outer side of the object of protection, the trochanter TP of femur, a gas-feeding path 51 which is disposed in a vicinity of the upper end 50*c* of the airbag 50 and connected to a gas generator (not-shown), and two gas channels 53 (53L, 53R) each of which provides gas communication between the gas-feeding path 51 and the protecting portion 52L/52R. The airbag 50 as laid flat is bilaterally symmetrical. Similarly to the wearable airbag device S1 in accordance with the first exemplary embodiment, the airbag 50 is stored inside an outer cover 25 as indicated with a dashed-and-double-dotted line in FIG. 17, and is adapted to be wrapped around the pelvis MP of the wearer M by the gas-feeding path 51 through the use of a belt (not-shown) of the outer cover 25, in a similar fashion to the wearable airbag device S1 in accordance with the first exemplary embodiment. The gas-feeding path 51 serves as an applying portion that is applied to a circumference of the pelvis MP.

Figure 16:
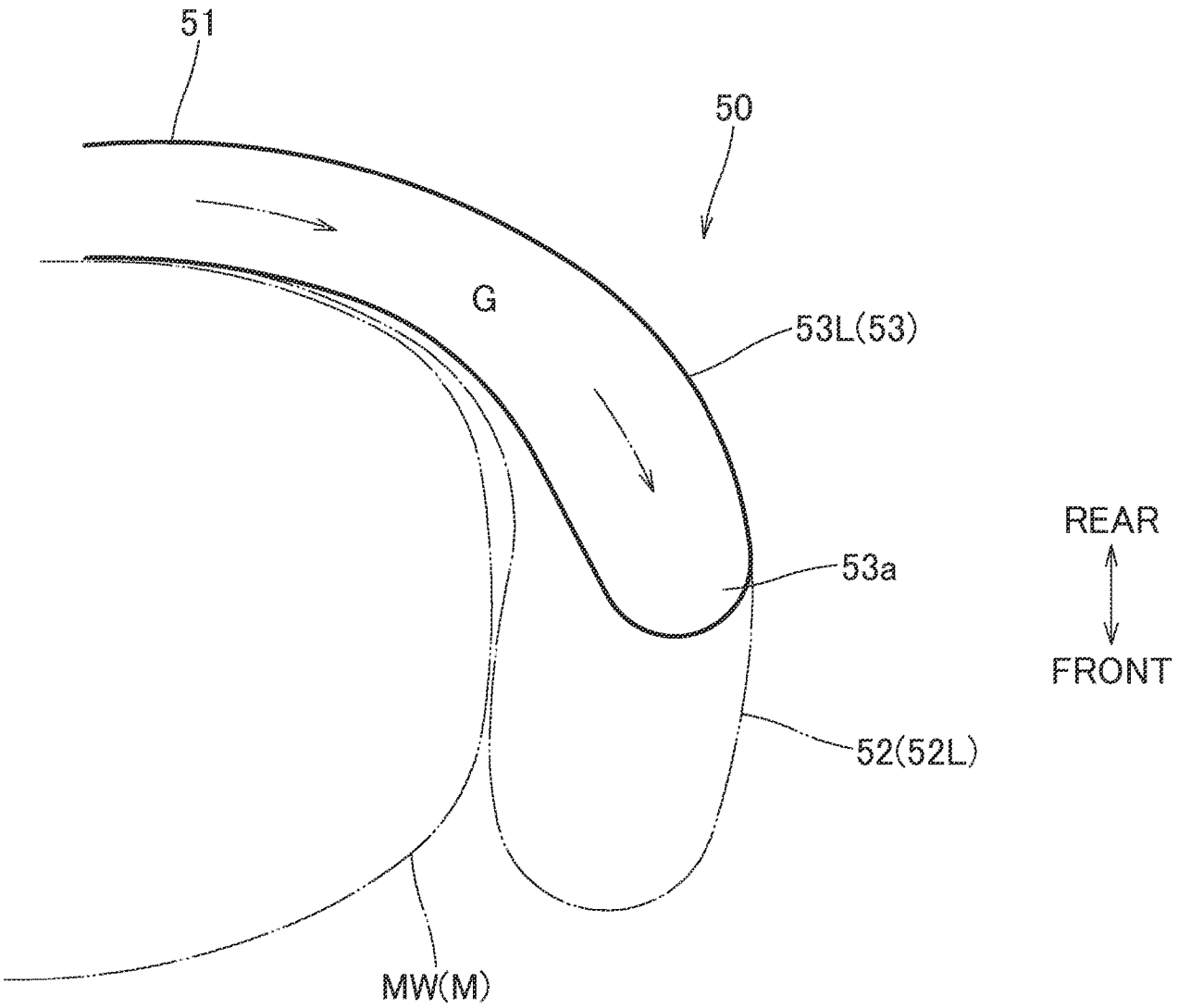
FIG. 16 is a schematic horizontal sectional view of the airbag of FIG. 14 illustrating a flow of an inflation gas at airbag deployment.

The gas-feeding path 51 is disposed in a vicinity of the upper end 50*c* of and at the center in a left and right direction of the airbag 50. The gas-feeding path 51 is configured to be inflated into a rod shape elongated substantially along the left and right direction at the back of the pelvis MP of the wearer M, as can be seen in FIGS. 15 and 16. Similarly to the gas-feeding path 12 of the afore-described airbag 10, the gas-feeding path 51 is connected to a not-shown gas generator.

Figure 17:
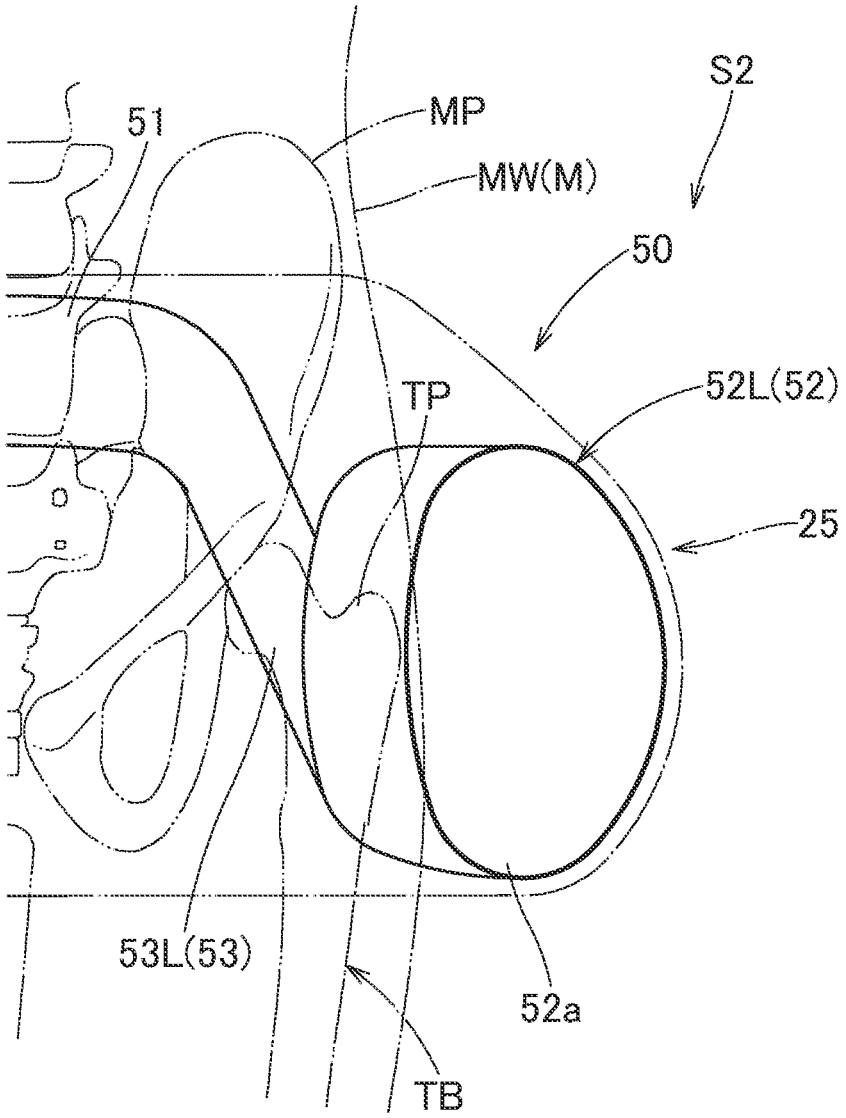
FIG. 17 is a schematic vertical sectional view of the airbag of FIG. 14 as deployed in a worn state.

Each of the protecting portions 52 (52L, 52R) is disposed such that the upper end is disposed at a farther downward position than the upper edge of the gas-feeding path 51, in a stepped manner with respect to the gas-feeding path 51, as can be seen in FIG. 14. That is, each of the protecting portions 52 (52L, 52R) is designed to be deployed at a lower position than the gas-feeding path 51 deployed at the back of the pelvis MP, in other words, at a lower position than the pelvis MP, as can be seen in FIG. 17. The two gas channels 53 (53L, 53R) extend downwardly and outwardly in the left and right direction from opposite ends of the gas-feeding path 51, then each turns upward at a position beneath the protecting portion 52 and is connected to a lower end 52*a* of the protecting portion 52 by the leading end 53*a*. More specifically, in the airbag 50 as laid flat, each of the gas channels 53 is formed into a substantially J shape whose leading end 53*a* is connected to a front lower end of the protecting portion 52 as worn. Each of the protecting portions 52 is formed substantially into a rectangle that protrudes inward in the left and right direction from the leading end 53*a* of the gas channel 53, in the airbag 50 as laid flat. As can be seen in FIGS. 15 and 17, each of the protecting portions 52 is designed to cover an outer side of the trochanter TP of femur amply in a front and rear direction and in an up and down direction at airbag deployment.

In the wearable airbag device S2 in accordance with the second exemplary embodiment employing the airbag 50, each of the protecting portions 52 for covering outer sides of the trochanters TP of femurs is designed to receive an inflation gas for inflation from the lower side via the gas-feeding path 51 and gas channel 53, in an initial stage of airbag deployment. With this configuration, referring to FIG. 16, the inflation gas G will flow away from the center of the wearer M in the gas channels 53, but turn and flow toward the center of the wearer M when entering into the protecting portions 52 since the airbag 50 is mounted around the pelvis MW by the upper end 50*c* portion. More specifically, in the airbag 50, the leading end 53*a* of each of the gas channels 53 is connected to the front lower end of each of the protecting portions 52 which are disposed apart from the gas-feeding path 51, so that the protecting portion 52 will receive the inflation gas from the front lower end. At this time, the inflation gas flows toward the center in a horizontal direction of the body of the wearer M inside the protecting portions 52. This flow of inflation gas inside the airbag 50 will prevent the protecting portions 52 from being separated from the wearer M at airbag deployment, so that the airbag 50 will be able to cover an outer side of the object of protection (i.e. outer sides of the trochanters TP of femurs) with the protecting portions 52 adequately.

The wearable airbag devices of the foregoing embodiments include a belt so as to be put on around the hip with the use of the belt. However, the application of the invention should not be limited to the disclosed embodiments. By way of example, the invention may be applied to a wearable airbag device which is formed into a vest, a jacket or the like for wearing on the torso and configured to deploy an airbag from the lower end as worn. Although the airbags of the foregoing embodiments are each stored inside the outer cover in an unfolded state, the airbag may be stored inside the outer cover in a folded state.

Figure 18:
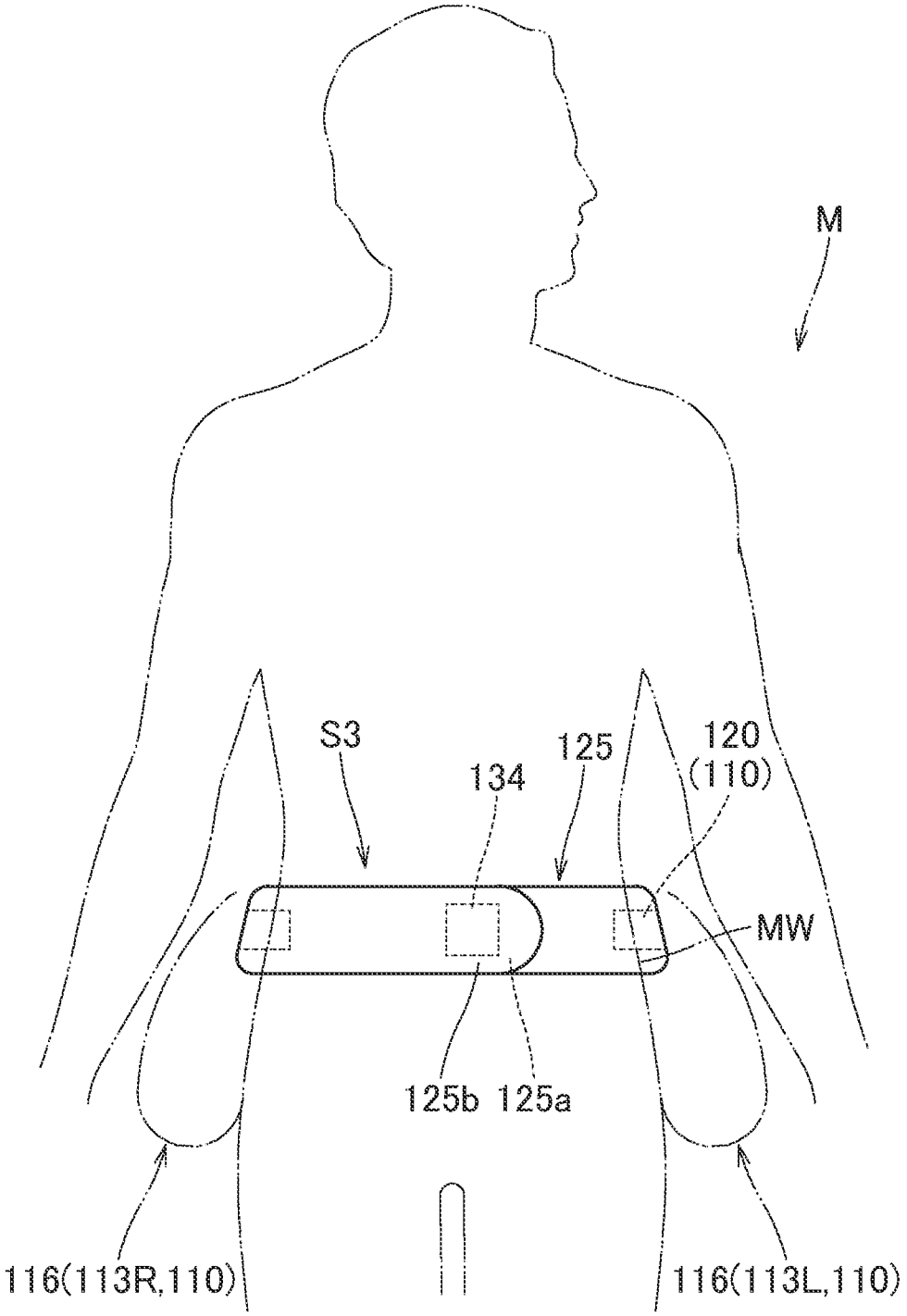
FIG. 18 schematically depicts a wearable airbag device in accordance with the third embodiment as worn by a wearer.

A wearable airbag device S3 in accordance with the third exemplary embodiment is now described. As can be seen in FIG. 18, the wearable airbag device S3 is also configured to be worn by a wearer M around the hip MW (more particularly, around the pelvis MP).

Figure 19:
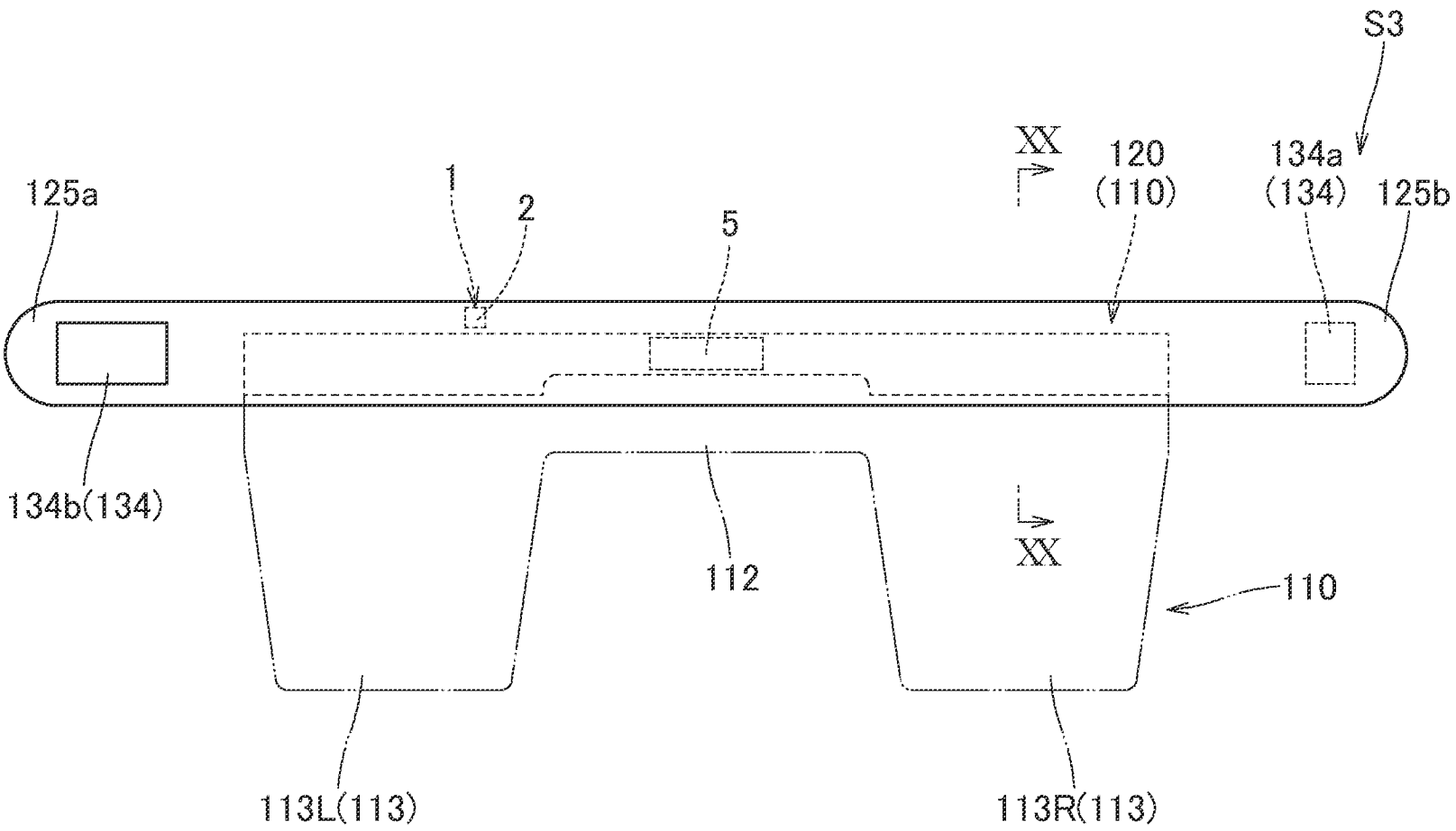
FIG. 19 is a plan view of the wearable airbag device in accordance with the third embodiment as laid flat.
Figure 20:
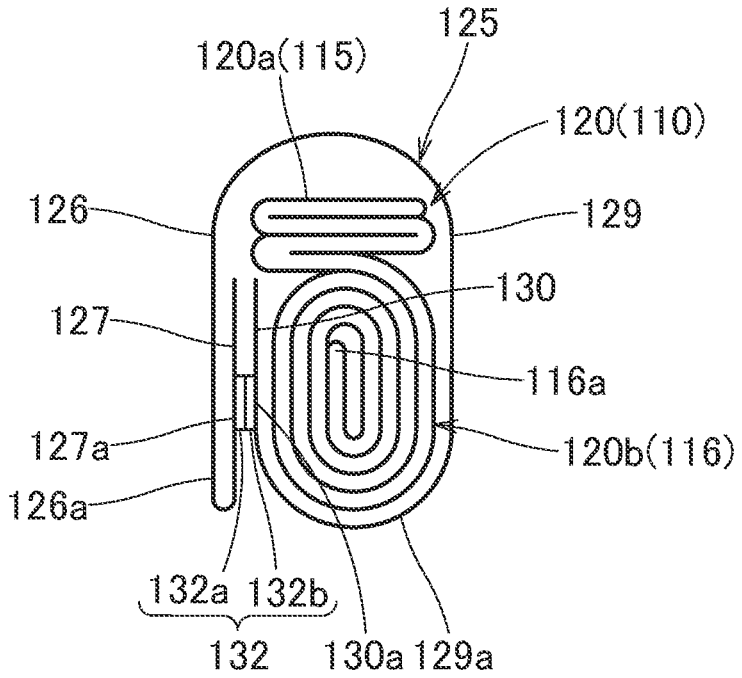
FIG. 20 is a schematic vertical sectional view taken along line XX-XX of FIG. 19.

Referring to FIGS. 18 to 20, the wearable airbag device S3 includes an airbag 110, a gas generator 5 for feeding the airbag 110 with an inflation gas, an operation control device 1 that includes a sensor part 2 for detecting a fall of the wearer M and is configured to actuate the gas generator 5, and an outer cover 125 that covers an outer circumference of the airbag 110. The operation control device 1 and the gas generator 5 have the same structures as those in the first exemplary embodiment, thus will not be described in detail.

Figure 21:
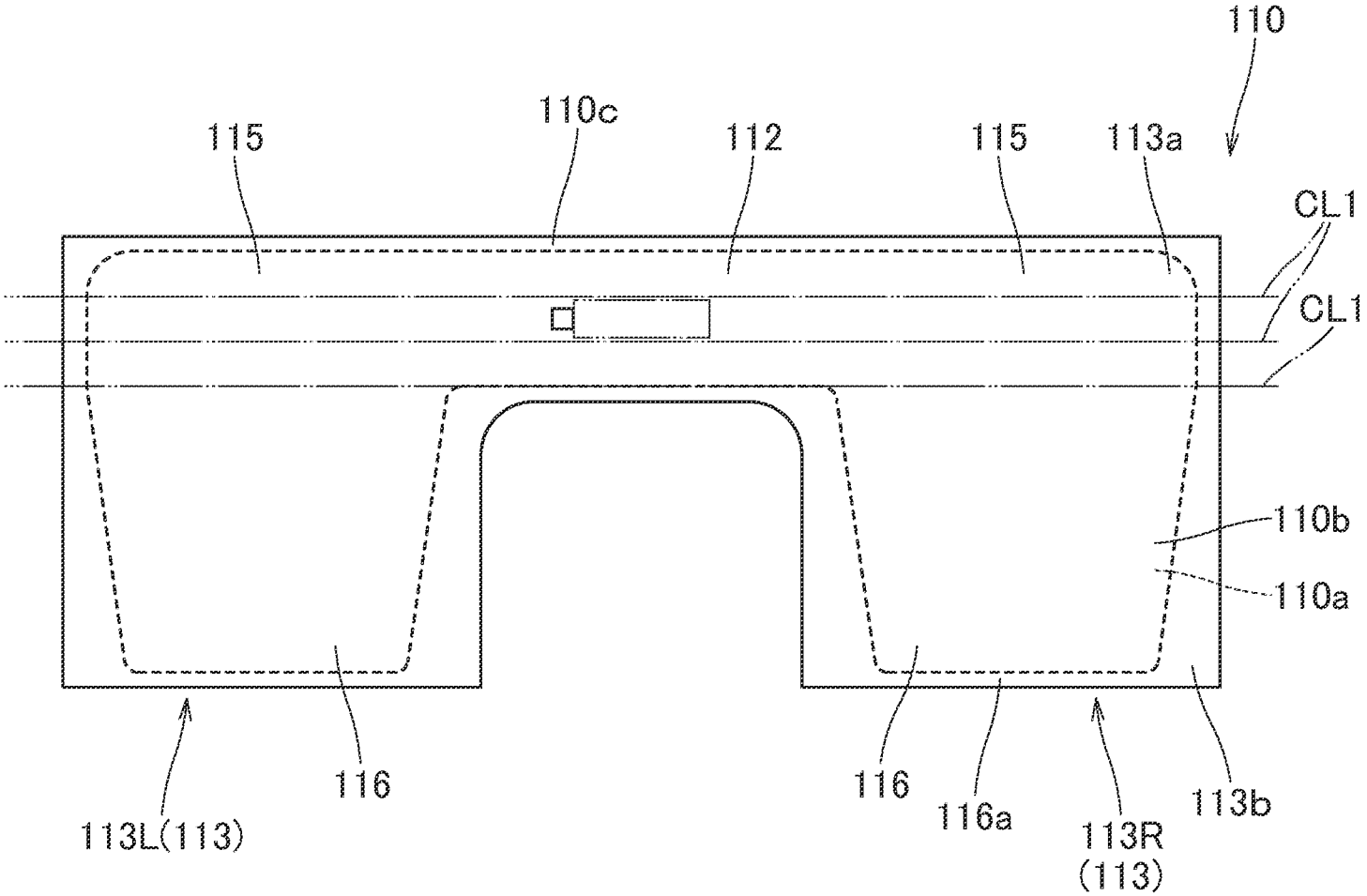
FIG. 21 is a plan view of an airbag for use in the wearable airbag device of the third embodiment as unfolded.

The airbag 110 is made of a sheet material having flexibility. The airbag 110 of this specific embodiment is made of a fabric woven with polyester yarns, polyimide yarns or the like. As can be seen in FIG. 21, the airbag 110 includes an inner wall 110*a* that is configured to face the wearer M (i.e. in the inner side) at airbag deployment, and an outer wall 110*b* that is configured to face away from the wearer M at airbag deployment. The inner wall 110*a* and outer wall 110*b* are substantially identical in outer shape. The airbag 110 is formed by sewing (or jointing) circumferential edges of the inner wall 110*a* and outer wall 110*b* together into a bag, thus is inflatable into a substantially board shape. In one or more embodiments, the airbag 110 may be formed by OPW technology. As shown in FIG. 21, the airbag 110 of this embodiment includes two bag bodies 113 (113L, 113R) that are configured to cover the left and right sides of the hip MW of the wearer M at airbag deployment, respectively, and a gas-feeding path 112 that provides gas communication between the bag bodies 113 (113L, 113R) at a vicinity of upper ends 113*a* of the bag bodies 113. The airbag 110 as laid flat is bilaterally symmetrical.

The gas-feeding path 112 is designed to be inflated into a rod shape elongated substantially along a left and right direction. The gas-feeding path 112 of this embodiment is adapted to be deployed at the back of the pelvis MP of the wearer M though not depicted in detail. In this embodiment, the gas generator 5 is connected to the gas-feeding path 112 for feeding the airbag 110 with an inflation gas, as shown in FIGS. 19 and 21.

Referring to FIG. 21, each of the bag bodies 113 (113L, 113R) of this embodiment includes a contact portion 115 disposed in a vicinity of the upper end 113*a* and a protecting portion 116 that is configured to extend downward from the contact portion 115 at airbag deployment.

Figure 23:
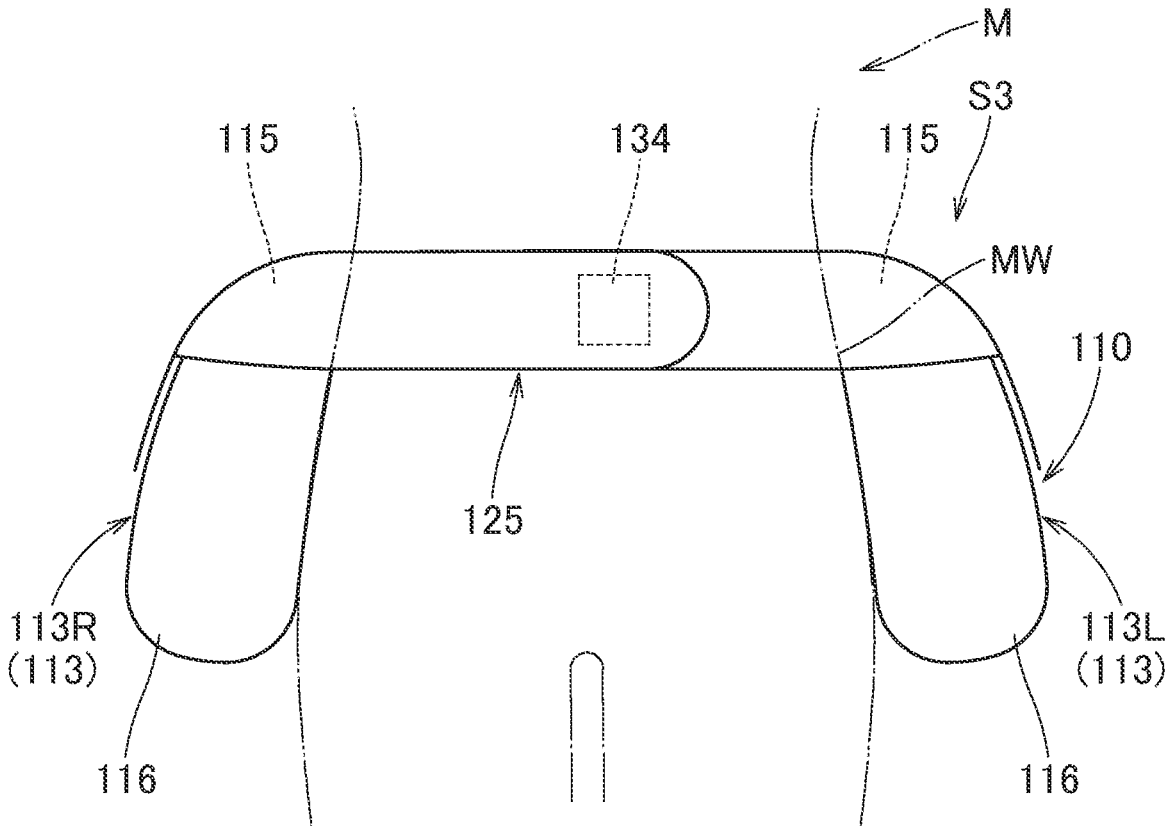
FIG. 23 schematically depicts the airbag of FIG. 21 as fully deployed in a worn state.
Figure 25:
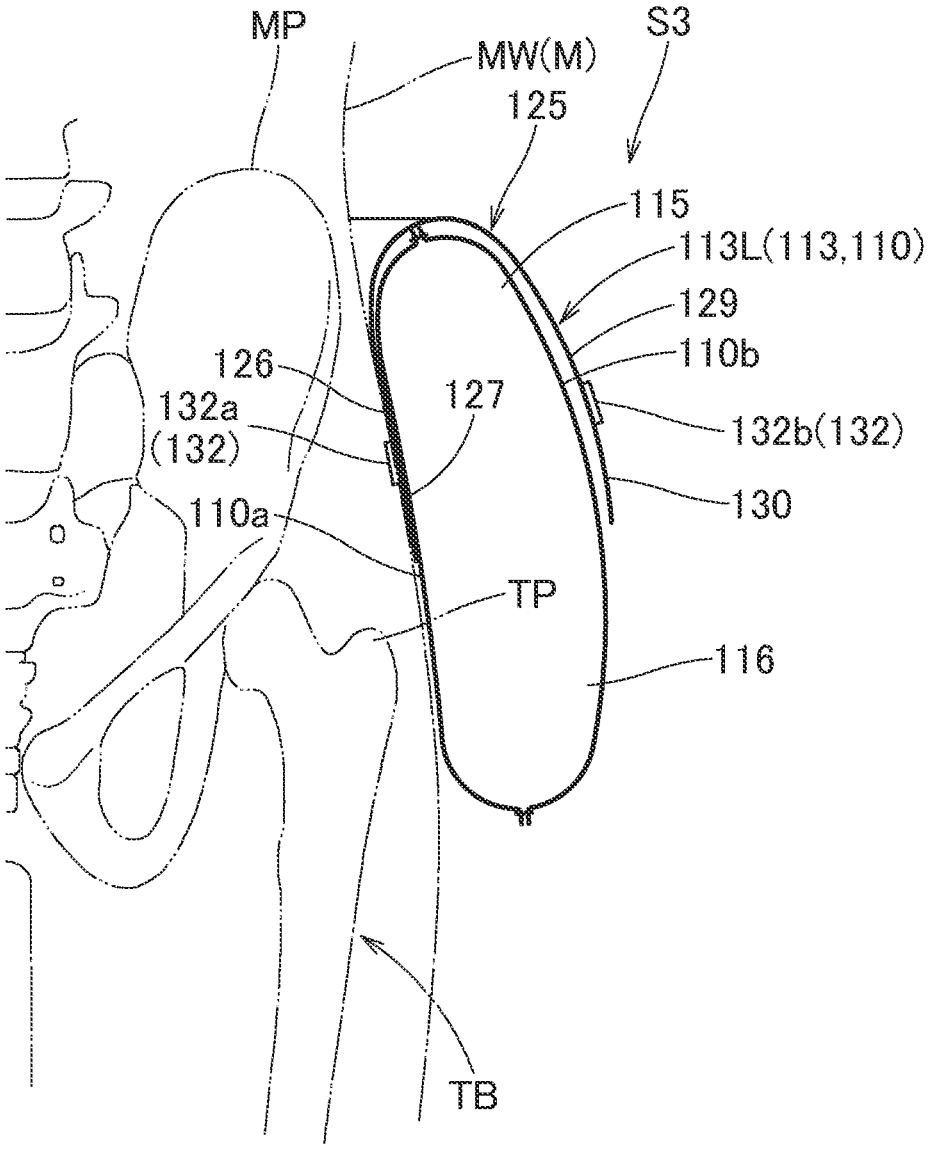
FIG. 25 is a schematic vertical sectional view of the airbag of FIG. 21 as deployed in a worn state.

The contact portion 115 of this embodiment is a portion continuous with the gas-feeding path 112 and disposed on extensions to the left and right of the gas-feeding path 112 in the airbag 110 as laid flat. That is, the contact portion 115 is disposed in a vicinity of upper ends 113*b* of the bag bodies 113. The contact portion 115 is designed to be deployed on the left and right sides of the pelvis MP of the wearer M at airbag deployment in a worn state, as can be seen in FIGS. 23 and 25. The contact portion 115 of this specific embodiment is intended to refer to a portion that is disposed substantially in an entirety in the left and right direction of an upper edge 110*c* region of the airbag 110 as laid flat, including the gas-feeding path 112.

Figure 24:
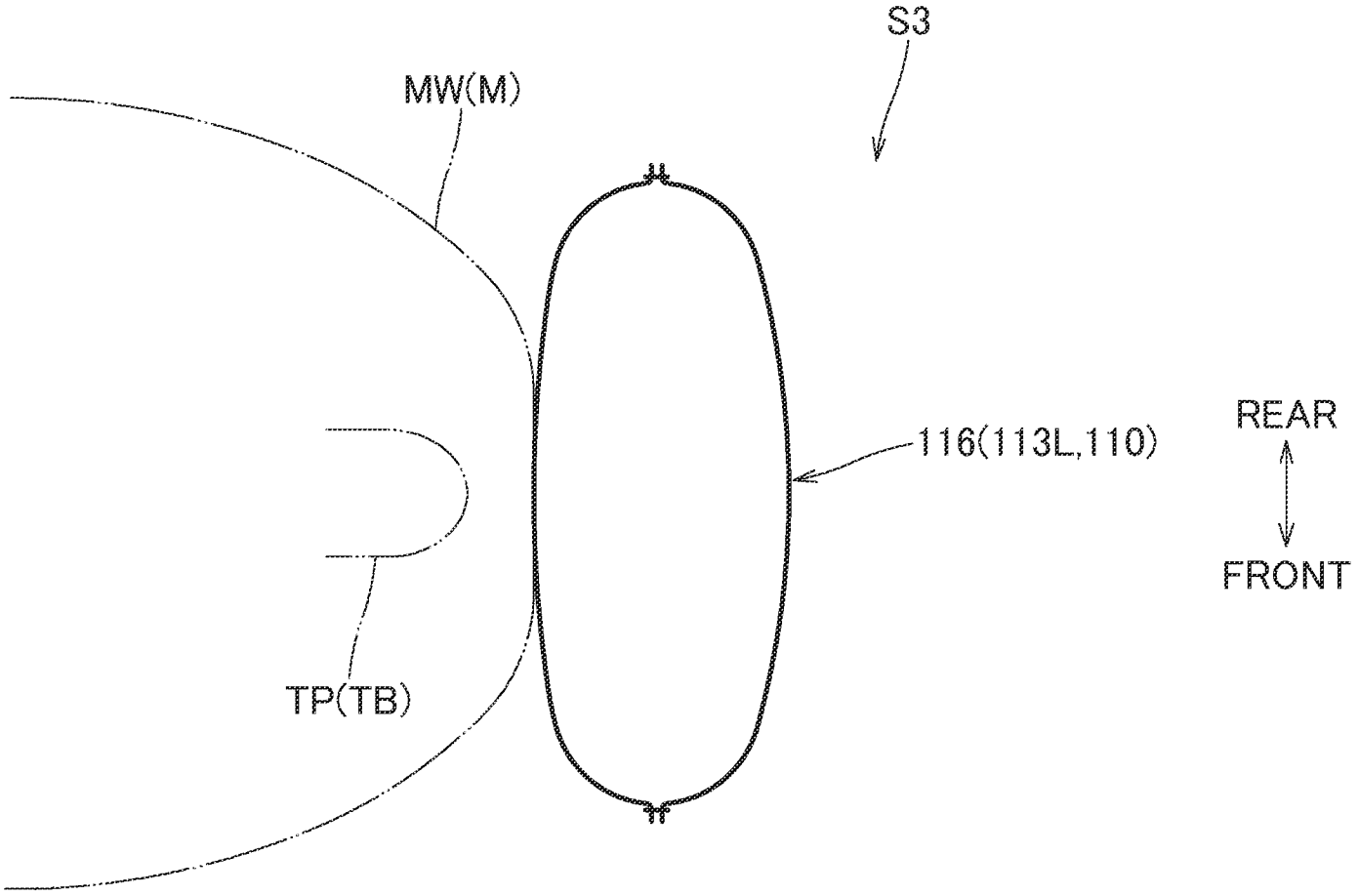
FIG. 24 is a schematic partial horizontal sectional view of the airbag of FIG. 21 as deployed, taken along a front and rear direction. More particularly.

Each of the protecting portions 116 is designed to extend downward from the contact portion 115 and cover an outer side of the trochanter TP of femur as an object of protection at airbag deployment. In this embodiment, in order to cover the trochanter TP of femur amply, the protecting portion 116 as laid flat has a substantially trapezoidal outer shape that has a greater width in the left and right direction than that in the up and down direction, and slightly narrows toward the lower end. The width in the left and right direction of the protecting portion 116 is substantially identical to that of the contact portion 115. As can be seen in FIGS. 24 and 25, each of the protecting portions 116 is designed to cover the outer side of the trochanter TP of femur amply both in the front and rear direction and in the up and down direction at airbag deployment. Each of the protecting portions 116 of this embodiment is internally provided with a not-shown tether that connects the inner wall 110*a* and outer wall 110*b* in order to regulate the thickness of the protecting portion 116 at airbag deployment.

Figure 22A:
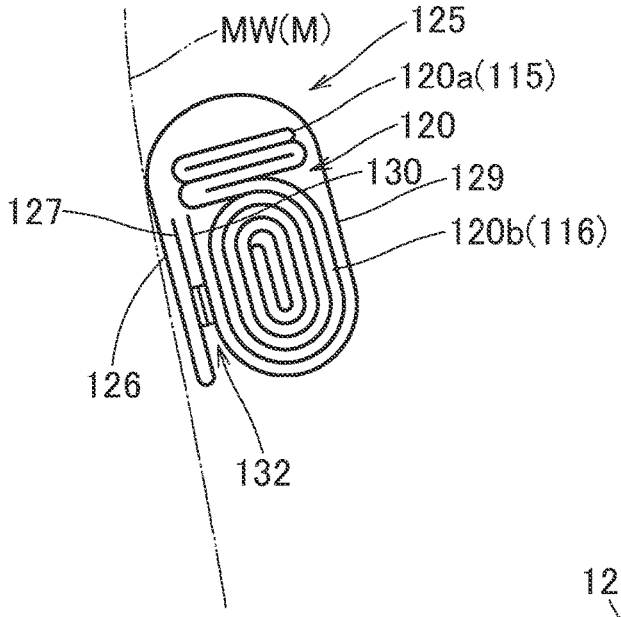
FIGS. 22A, 22B and 22C illustrate a deployment process of the airbag of FIG. 21 as worn by a wearer by schematic sectional views.

The airbag 110 of this embodiment is stored in a storage in the form of a folded body 120, a form of the airbag 110 that has been folded and has a reduced width in an up and down direction compared to that in an unfolded state in which the inner wall 110*a* and the outer wall 110*b* are laid flat one over another. In this embodiment, the folded body 120 is stored inside the outer cover 125, and put on around the pelvis MP of the wearer M in that state, as can be seen in FIG. 22A. The outer cover 125 constitutes the storage that stores the airbag 110 as folded, i.e. the folded body 120. The airbag 110 of this embodiment is configured such that the contact portion 115 is inflated with an inflation gas first and the contact portion 115 as inflated pushes and deploys the protecting portion 116 downward in an initial stage of airbag deployment. To describe more specifically, the airbag 110 is folded from the unfolded state as follows: an upper end portion of the airbag 110 composed of the contact portions 115 and gas-feeding path 112 is folded in a concertina fashion on a plurality of creases CL1 (FIG. 21) extending in the front and rear direction (in other words, in the left and right direction of the airbag 110 as unfolded), while each of the protecting portions 116 is rolled on the inner wall 110*a* (i.e. toward the wearer side) from the lower edge 116*a*, In the folded body 120, the concertina-fold portion 120*a* and the rolled portion 120*b* are arranged one above another, as can be seen in FIG. 20.

The outer cover 125 covering the outer circumference of the folded body 120 is formed substantially into a band shape. The outer cover 125 of this embodiment is made of a flexible fabric having better touch than the base cloth of the airbag 110. The outer cover 125 includes an inner wall 126 that is disposed in the inner side (i.e. towards the wearer M) when worn, and an outer wall 129 that is disposed on the outer side when worn. In this embodiment, a lower edge portion 126*a* of the inner wall 126 and a lower edge portion 129*a* of the outer wall 129 are jointed together in such a manner as to be separable from one another when pushed by the airbag 110 in an initial stage of airbag deployment. More particularly, the lower edge portion 126*a* of the inner wall 126 and the lower edge portion 129*a* of the outer wall 129 are jointed together by a hook-and-loop fastener 132 including hooks 132*a* and loops 132*b*. The hook-and-loop fastener 132 serves as a jointing means. A joint strength of the lower edge portion 126*a* and the lower edge portion 129*a* is such that they are unjointed when pushed by the inflated airbag 110 in the initial stage of airbag deployment. Each of the inner wall 126 and outer wall 129 includes, in the lower edge portion 126*a*/29*a*, a folded-in portion 127/130 that is folded inward. The hook-and-loop fastener 132 is disposed in root portions 127*a* and 130*a* of the folded-in portions 127 and 130 to join the root portions 127*a* and 130*a*. When the hooks 132*a* and loops 132*b* of the hook-and-loop faster 132 are disengaged from one another in the initial stage of airbag deployment, the folded-in portions 127 and 130 unfold and extend downward. The folded-in portions 127 and 130 as unfolded and extended downward serve as a guide portion that leads the airbag 110 to deploy downward. As can be seen in FIG. 25, the inner wall 126 and outer wall 129 of the outer cover 125 including the folded-in portions (the guide portion) 127, 130 are designed to cover approximately an upper half area of the bag body 113 of the airbag 110 as deployed. Outer circumferential edges of the inner wall 126 and outer wall 129 of the outer cover 125 except the lower edges 126*a* and 129*a* are configured to stay jointed together even after airbag deployment.

The outer cover 125 includes a fastening means for application to the hip MW of the wearer M at opposite ends 125*a*, 125*b* in the length direction. The fastening means in this embodiment is composed of a hook-and-loop fastener 134 including hooks 134*a* and loops 134*b* engageable with one another so as to enable the wearer M to wear the airbag device S3 easily according to the size of the waist.

The wearable airbag device S3 in accordance with the third exemplary embodiment is put on around the hip MW (pelvis MP) of the wearer M in a wrapping manner by fastening the opposite ends 125*a*, 125*b* of the outer cover 125 together with the use of the hook-and-loop fastener 134 (as the fastening means). If the sensor part 2 detects a falling behavior of the wearer M as wearing the airbag device S3, the operation control device 1 sends an actuating signal to the gas generator 5, the gas generator 5 feeds an inflation gas to the airbag 110, so that the airbag 110 unfolds and deploys as shown in FIGS. 18 (with dashed-and-double-dotted lines) and 23 to 25.

Figure 22B:
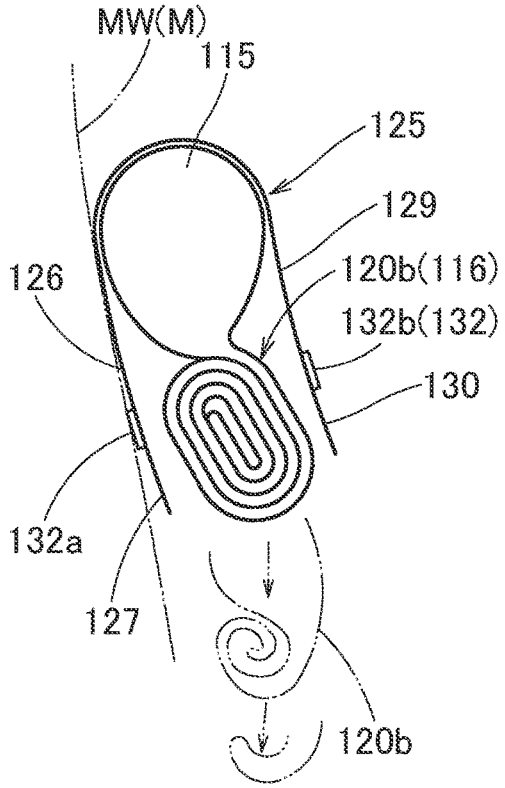

In the wearable airbag device S3 in accordance with the third exemplary embodiment, although each of the protecting portions 116 for covering an outer side of the trochanter TP of femur (i.e. the object of protection) is configured to be deployed in such a manner as to extend downward from the contact portion 115 disposed at a side of the pelvis MP, the airbag 110 is configured so that the contact portions 115 are inflated first and the contact portions 115 as inflated push and deploy the protecting portions 116 downward, as can be seen in FIGS. 22A and 22B. This configuration will help deploy the protecting portions 116 in a manner prevented from floating away from the wearer M, in other words, in proximity to the object of protection, the trochanters TP of femurs. Therefore, the protecting portions 116 are able to cover the outer sides of the trochanters TP of femurs as the object of protection quickly and adequately.

Therefore, the wearable airbag device S3 in accordance with the third exemplary embodiment is able to protect the hip MW of the wearer M in a steady fashion.

More particularly, in the wearable airbag device S3 in accordance with the third exemplary embodiment, the contact portion 115 is folded in a concertina fashion while the protecting portion 116 is rolled from the lower edge 116*a*. This configuration will help inflate the contact portion 115 quickly so that the protecting portion 116 as has been folded will unfold and be deployed downward quickly. In this embodiment, especially, since the contact portion 115 is continuous with the gas-feeding path 112 connected with the gas generator 5 and configured to be inflated into a rod shape integrally with the gas-feeding path 112, the contact portion 115 will be inflated quickly. Further, since the protecting portion 116 is disposed immediately below the concertina-fold portion 120*a* (i.e. the contact portion 115) in a rolled state, the protecting portion 116 will be pushed downward by the contact portion 115 as inflated and be inflated while unfolding as can be seen in FIGS. 22A and 22B, so that the protecting portion 116 will be prevented from floating away from the wearer M during inflation adequately. If such advantageous effects do not have to be considered, the airbag may alternatively be configured such that a contact portion as folded in a concertina fashion is disposed on an inner side (on the side to face the wearer) of a protecting portion as rolled.

Figure 22C:
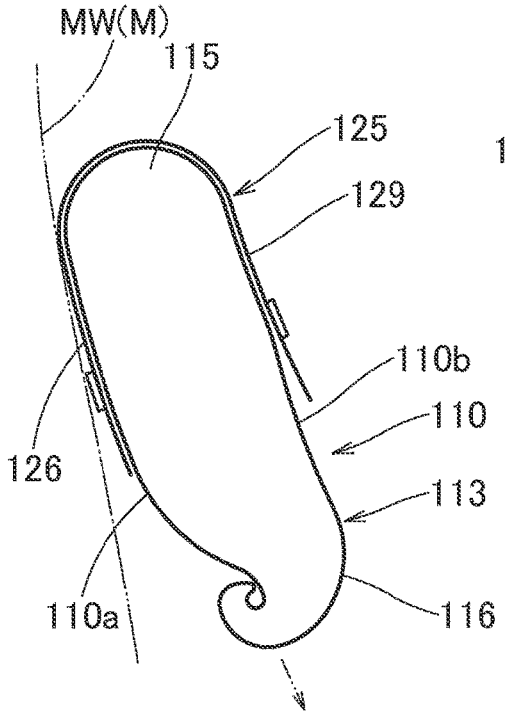

In this embodiment, moreover, the protecting portion 116 is rolled on the inner wall 110*a* (i.e. toward the side facing the wearer M) from the lower edge 116*a*. With this configuration, the protecting portion 116 will unroll along the body of the wearer M when unrolling as can be seen in FIGS. 22B and 22C, thus will be prevented from floating away from the body of the wearer M further adequately. If such an advantageous effect does not have to be considered, the protecting portion may be rolled on the outer wall (i.e. on the side facing away from the wearer) from the lower edge.

In the wearable airbag device S3 in accordance with the third exemplary embodiment, furthermore, the airbag 110 in the form of the folded body 120 is stored in the outer cover 125 that includes the inner wall 126 that is adapted to face the wearer when worn and the outer wall 129 that is adapted to face away from the wearer when worn. The outer cover 125 will prevent the airbag 110 from being deployed toward a direction apart from the wearer M and guide the airbag 110 downward. The outer cover 125 will also improve an appearance of the wearable airbag device S3. If such an advantageous effect does not have to be considered, the wearable airbag device may be formed without an outer cover.

In the wearable airbag device S3 in accordance with the third exemplary embodiment, the lower end portion 126*a* of the inner wall 126 of the outer cover 125 and the lower end portion 129*a* of the outer wall 129 of the outer cover 125 are separably jointed together, and the lower end portion 126*a* of the inner wall 126 and the lower end portion 129*a* of the outer wall 129 are configured to be separated from one another by the airbag 110 and configured to lead the airbag 110 to deploy downward in an initial stage of airbag deployment. More specifically, Each of the inner wall 126 and outer wall 129 of the outer cover 125 includes, in the lower edge portion 126*a*/129*a*, the folded-in portion 127/130 that is folded inward. The folded-in portions 127 and 130 are configured to turn and extend downward in the initial stage of airbag deployment, and serve as the guide portion that leads the airbag 110 to deploy downward. This configuration prevents foreign matter from entering into the outer cover 125 from below. Further, the folded-in portions (i.e. the guide portions) 127, 130 further prevent the airbag 110 from floating away from the body of wearer M during deployment. If such advantageous effects do not have to be considered, the lower end portion of the outer cover may be left open so as to allow the airbag to deploy therefrom. Further alternatively, the outer cover may be formed without the folded-in portions though the lower end portions of the inner wall and outer wall are separably jointed together. Although the outer cover 125 of this embodiment including the folded-in portions 127, 130 is designed to cover approximately an upper half area of the bag body 113 of the airbag 110 as deployed, the outer cover may alternatively be formed so long as to cover substantially an entirety of the bag body as deployed to a vicinity of the lower end by elongating the folded-in portions.

Figure 26:
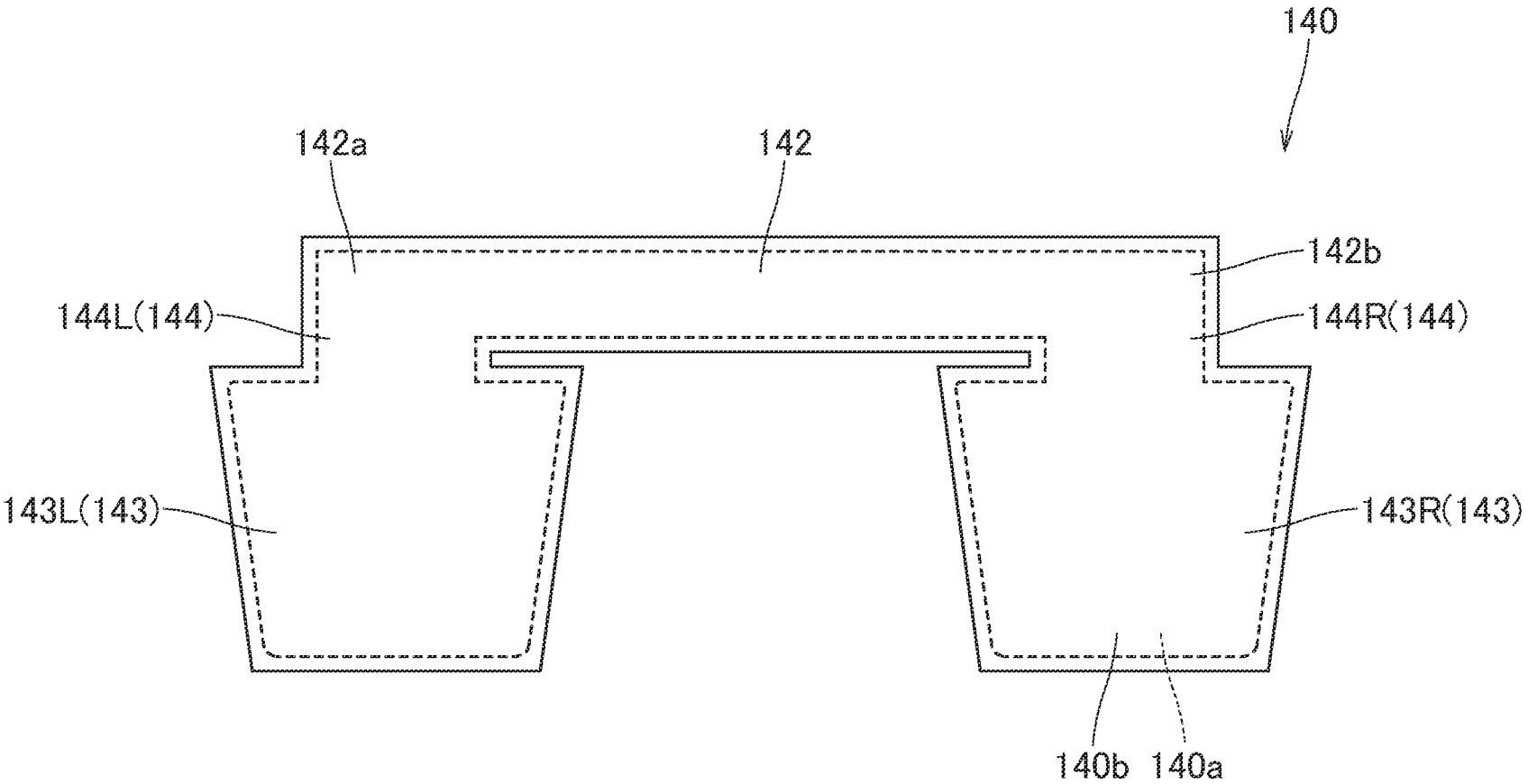
FIG. 26 is a plan view of a modification of the airbag in accordance with the third embodiment as unfolded.
Figure 28:
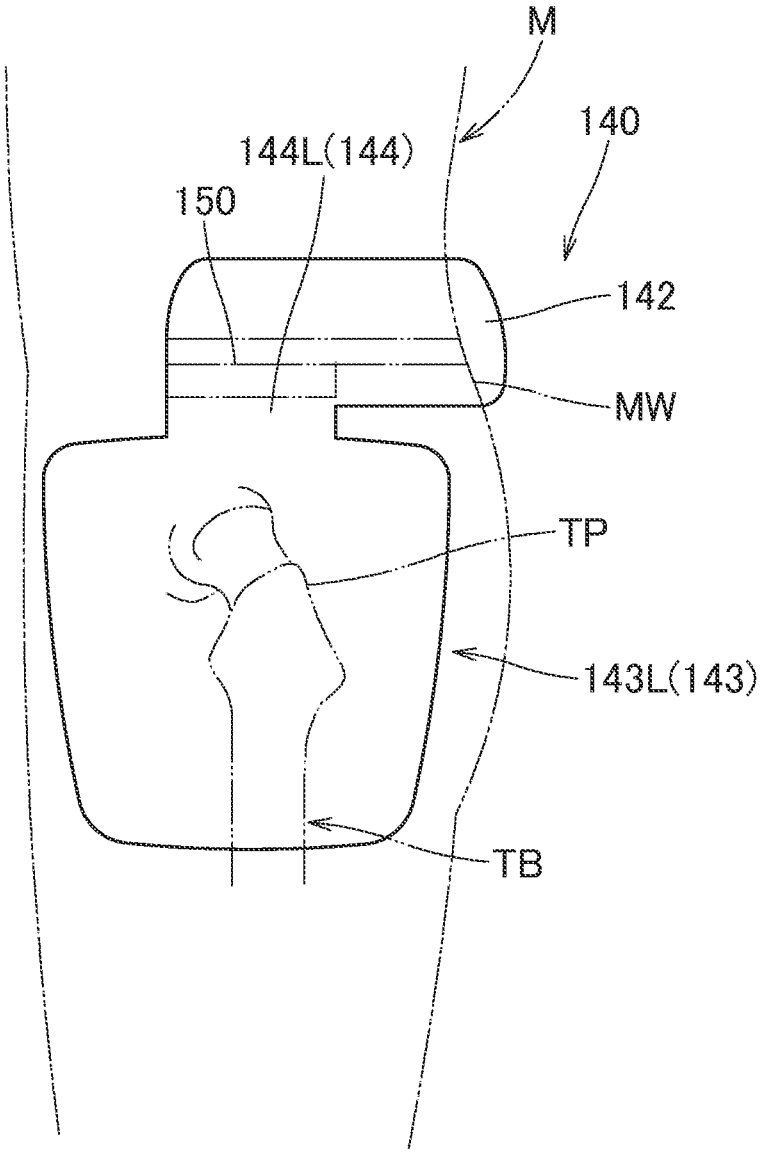
FIG. 28 is a schematic side view of the airbag of FIG. 26 as deployed in a worn state.

The airbag may be configured like an airbag 140 depicted in FIGS. 26 and 28. The airbag 140 includes an inner wall 140*a* that is disposed towards the wearer M (i.e. in the inner side) when worn, and an outer wall 140*b* that is disposed on the outer side when worn. The inner wall 140*a* and outer wall 140*b* are substantially identical in outer shape. The airbag 140 is formed by sewing (or jointing) circumferential edges of the inner wall 140*a* and outer wall 140*b* together into a bag, thus is inflatable into a substantially board shape. The airbag 140 as laid flat is bilaterally symmetrical. The airbag 140 includes a contact portion 142 that is configured to be deployed on left, back and right sides of the pelvis MP of a wearer M at airbag deployment, two protecting portions 143 (143L, 143R) that are configured to be deployed beneath opposite end portions of the contact portion 142, and two communication portions 144 (144L, 144R) each of which provides gas communication between the contact portion 142 and each of the protecting portions 143. Each of the communication portions 144 extends downward from an end 142*a*/142*b* of the contact portion 142. Each of the protecting portions 143 is designed to cover an outer side of the trochanter TP of femur as an object of protection in the left/right side of the wearer M, and has a greater width in a left and right direction (i.e. in a front and rear direction in a worn state) than each of the communication portions 144, in an unfolded state. More specifically, each of the protecting portions 143 as unfolded has a substantially trapezoidal outer shape that slightly narrows toward the lower end, and is designed to cover the outer side of the trochanter TP of femur amply both in the front and rear direction and in the up and down direction at airbag deployment, as can be seen in FIG. 28. An outer cover is omitted in FIG. 28.

Figure 27A:
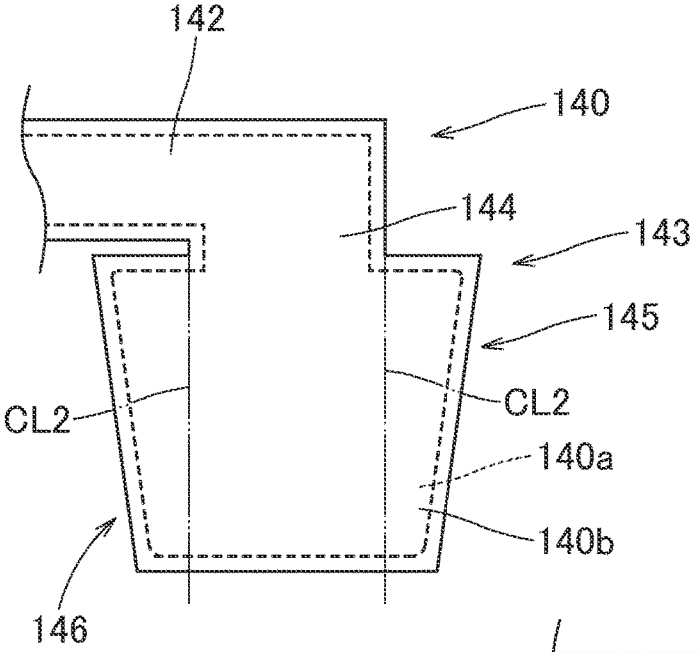
FIGS. 27A, 27B and 27C schematically illustrate a folding process of the airbag of FIG. 26.
Figure 27B:
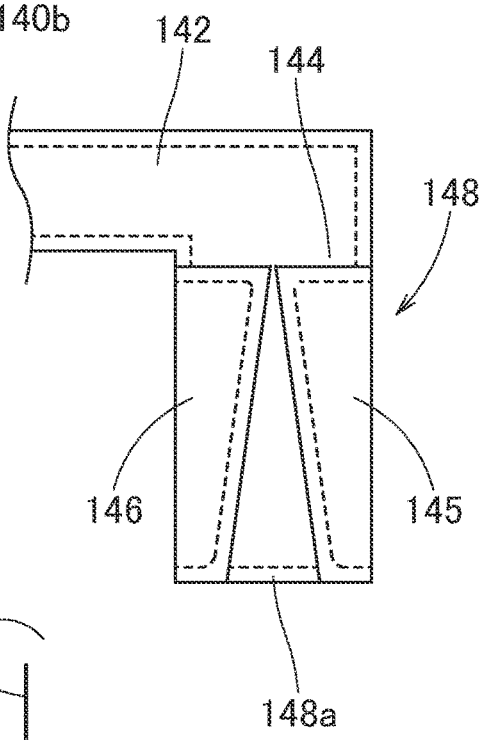
Figure 27C:
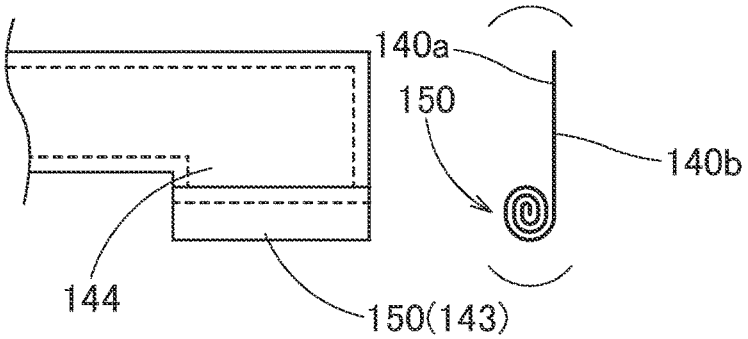

The airbag 140 is also stored in a not-shown outer cover in the form of a folded body, a form of the airbag 140 that has been folded and has a reduced width in an up and down direction compared to that in an unfolded state in which the inner wall 140*a* and the outer wall 140*b* are laid flat one over the another. More specifically, the airbag 140 is folded from the unfolded state as follows: an upper end portion of the airbag 140 composed of the contact portion 142 is folded in a concertina fashion on a plurality of creases extending in the front and rear direction (in other words, in the left and right direction of the airbag 140 as unfolded), while each of the protecting portions 143 is folded and reduced in width in the up and down direction. More particularly, each of the protecting portions 143 is folded firstly by a front-rear contracting folding that reduces the width in the left and right direction (i.e. in the front and rear direction in a worn state) of the protecting portion 143 as laid flat, then by an up-down contracting folding that reduces the width in the up and down direction of the protecting portion 143. As can be seen in FIGS. 27A and 27B, each of the protecting portions 143 includes a front portion 145 that protrudes farther forward (or toward the left or right in the unfolded state) than the communication portion 144 and a rear portion 146 that protrudes farther rearward (or toward the left or right in the unfolded state) than the communication portion 144. In the front-rear contracting folding, the front portion 145 and rear portion 146 are folded toward the center in the front and rear direction on the outer wall 140*b* on creases CL2 extending along the up and down direction. This provides a front-rear contracted bag 148. In the up-down contracting folding, as can be seen in FIGS. 27B and 27C, the front-rear contracted bag 148 is rolled on the inner wall 140*a* from the lower edge 148*a*, thus providing a rolled portion 150.

At deployment of the airbag 140 configured as described above, the contact portion 142 will be inflated first and push each of the protecting portions 143 downward, then each of the protecting portions 143 will be inflated while the rolled portion 150 unrolls (that is, the folds that were formed in the up-down contracting folding unfold) first, then the folds that were formed in the front-rear contracting folding unfold. Thus the protecting portions 143 cover the outer sides of the trochanters TP of femurs (i.e. the object of protection) quickly and amply in the up and down direction. The protecting portions 143 will be also prevented from being displaced with respect to the trochanters TP of femurs in the front and rear direction. In the airbag 140, especially, since a lower end portion of each of the protecting portions 143 is rolled on the inner wall 140*a* from the lower edge (from the lower edge 148*a* of the front-rear contracted bag 148) in the up-down contracting folding, this portion will unroll along the body of the wearer M and be prevented from floating away from the wearer M adequately. Moreover, each of the protecting portions 143 is stored in the not-shown outer cover in a form that is reduced in width in the front and rear direction. This configuration will avoid bulkiness. More particularly, since the rolled portion 150 formed by folding the protecting portion 143 is reduced in width in the front and rear direction to a substantially same width as that of the communication portion 144 as indicated with dashed-and-double-dotted lines in FIG. 28, the rolled portion 150 will be prevented from becoming bulky, which will reduce a feeling of strangeness the wearer wearing the wearable airbag device S3 may have in walking or the like.

With the wearable airbag devices S1 to S3 in accordance with the foregoing exemplary embodiments, the two protecting portions 16, 52, 116, 143 of the airbags 10, 10A, 10B, 50, 110, 140 are able to cover vicinities of bases of the femurs TB (i.e. the trochanters TP of femurs) of the wearer M in a steady fashion. That is, the wearable airbag devices S1 to S3 in accordance with the exemplary embodiments will help prevent fractures of the femur TB that may take a long time to treat, thus will be suitable for use by elderly people.

In the wearable airbag devices S1 and S3 in accordance with the foregoing exemplary embodiments, the airbag 10, 10A, 10B, 110 includes the two bag bodies 13, 13A, 13B, 113 that are connected by the gas-feeding path 12, 112 and configured to protect the left and right objects of protections (i.e. the trochanters TP of femurs). However, the structure of the airbag should not be limited thereby. The wearable airbag device may alternatively include two separate airbags each connected with a gas generator for protecting the left/right object of protection.

The wearable airbag devices of the above embodiments are each designed to have a belt shape so as to be put on around the hip. However, the application of the invention should not be limited to the disclosed embodiment. By way of example, the invention may be applied to a wearable airbag device which is formed into a vest, a jacket or the like for wearing on the torso and includes a folded airbag in a lower end portion.

An exemplary embodiment relates to a wearable airbag device adapted to be worn by a wearer for protecting the hip of the wearer. The airbag device includes an airbag that is adapted to be put on a circumference of the pelvis of the wearer and configured to be inflated with an inflation gas. The airbag includes: an inner wall that is configured to face the wearer at airbag deployment, the inner wall having a circumferential edge; an outer wall that is configured to face away from the wearer at airbag deployment, the outer wall having a circumferential edge jointed with the circumferential edge of the inner wall so that the airbag has a substantially board shape when inflated; a contact portion that is disposed in an upper reach of a stream of the inflation gas and is configured to be deployed at least at a side of the pelvis at airbag deployment; at least one protecting portion that is configured to be deployed in such a manner as to extend downward from the contact portion for covering an outer side of the trochanter of femur of the wearer at airbag deployment; and a float-preventing means that is configured to prevent the protecting portion from floating away from the body of the wearer at airbag deployment.

In the wearable airbag device in accordance with the above exemplary embodiment, although the protecting portion for covering an outer side of the trochanter of femur is configured to be deployed in such a manner as to extend downward from the contact portion disposed at a side of the pelvis, the float-preventing means prevents the protecting portion from floating away from the hip, in other words, helps deploy the protecting portion in proximity to an object of protection (i.e. the trochanter of femur). Therefore, the protecting portion is able to cover the outer side of the trochanter of femur as the object of protection quickly and adequately.

Therefore, the wearable airbag device in accordance with the exemplary embodiment is able to protect the hip of the wearer in a steady fashion.

In one or more embodiments, the float-preventing means may be composed of a tether that connects the inner wall and the outer wall at a vicinity of a border between the contact portion and the protecting portion inside the airbag. The tether is configured such that, in the airbag as laid flat, an inner joint that connects a first edge of the tether to the inner wall is disposed at a higher position than an outer joint that connects a second edge of the tether to the outer wall.

The tether will suppress the airbag from being inflated too thick. Further, the tether is arranged such that the inner joint to the inner wall is disposed at a higher position than the outer joint to the outer wall. In other words, the tether makes a substantial film length of a portion of the inner wall forming the contact portion shorter than that of a portion of the outer wall forming the contact portion, each measured from an upper end of the airbag. This configuration will help bend the airbag at the inner joint of the tether at airbag deployment so that the lower end of the protecting portion is directed inward, i.e. toward the wearer, thus prevent the protecting portion from floating away from the hip of the wearer adequately. Therefore, the protecting portion is able to cover the outer side of the trochanter of femur as the object of protection adequately.

In one or more embodiments, the float-preventing means may be composed of a tuck that is formed in a region of the contact portion in the inner wall so as to make a film length in an up and down direction of the inner wall shorter than that of the outer wall. The tuck will make the film length in the up and down direction of the inner wall shorter than that of the outer wall and help bend the inner wall at the tuck, thus help deploy the airbag so that the lower end portion of the airbag (i.e. the lower end portion of the protecting portion) is directed toward the wearer (i.e. inward). Further, since the tuck is formed in the region of the contact portion which is disposed in an upper portion of the airbag, the airbag will bend at the tuck so that a substantially entirety in the up and down direction of the protecting portion deploys in proximity to the wearer, thus prevent the protecting portion from being separated from the object of protection (i.e. the trochanter of femur) adequately, so that the protecting portion will cover the outer side of the object of protection adequately.

In one or more embodiments, the float-preventing means may be composed of a bulkhead that partitions the contact portion from the protecting portion inside the airbag in such a manner as to allow gas communication between the contact portion and the protecting portion. The protecting portion is configured to be inflated thinner than the contact portion at airbag deployment.

When the airbag configured as described above is deployed, the contact portion will be inflated with an inflation gas first, then the protecting portion will be inflated. The protecting portion will receive the inflation gas from the contact portion via the bulkhead since the protecting portion and the contact portion are partitioned by the bulkhead. Further, the protecting portion is configured to be inflated thinner than the contact portion at airbag deployment. The trochanter of femur as the object of protection is positioned farther outward in the left and right direction with respect to the center in a horizontal direction of the body of the wearer compared to the pelvis. The airbag is designed such that the protecting portion for covering the outer side of the trochanter of femur is thinner than the contact portion to be disposed at the side of the pelvis at airbag deployment. In other words, the protecting portion is deployed in such a manner as to be recessed relative to the contact portion. With this configuration, the difference in thickness between the contact portion and protecting portion absorbs the protrusion of the trochanter of femur from the pelvis, so that the protecting portion will be prevented from being deployed in such a manner as to open downward, in other words in such a manner that the lower end of the protecting portion is separated from the wearer. Therefore, the protecting portion will be prevented from floating away from the wearer adequately, thus cover the outer side of the object of protection (i.e. the trochanter of femur) adequately.

Another exemplary embodiment relates to a wearable airbag device adapted to be worn by a wearer for protecting the hip of the wearer, the airbag device including a gas generator; and an airbag that is adapted to be put on a circumference of the pelvis of the wearer and configured to be inflated with an inflation gas fed from the gas generator. The airbag includes: an inner wall that is configured to face the wearer at airbag deployment, the inner wall having a circumferential edge; an outer wall that is configured to face away from the wearer at airbag deployment, the outer wall having a circumferential edge jointed with the circumferential edge of the inner wall so that the airbag has a substantially board shape when inflated; an applying portion that is disposed in a vicinity of an upper end of the airbag and adapted to be applied to the circumference of the pelvis; two protecting portions each of which is configured to cover an outer side of the trochanter of femur of the wearer; a gas-feeding path that is connected with the gas generator and adapted to be disposed at the back of the pelvis; and two gas channels each of which provides gas communication between the gas-feeding path and each of the protecting portions, each of the gas channels extending downwardly and outwardly in a left and right direction from the gas-feeding path, then turning upward at a position beneath the protecting portion and communicating with the protecting portion by a leading end thereof.

In the wearable airbag device configured as described above, each of the protecting portions for covering outer sides of the trochanters of femurs is designed to receive an inflation gas for inflation from the lower side via the gas-feeding path and gas channel. With this configuration, the inflation gas will flow away from the center of the wearer in the gas channels, but turn and flow toward the center of the wearer when entering into the protecting portions since the airbag is mounted around the pelvis by the upper end portion. This flow of inflation gas inside the airbag will prevent the protecting portions from being separated from the wearer at airbag deployment, so that the airbag will be able to cover the outer sides of the object of protection (i.e. the trochanters of femurs) with the protecting portions adequately.

Yet another exemplary embodiment relates to a wearable airbag device adapted to be worn by a wearer for protecting the hip of the wearer, the airbag device including an airbag that is adapted to be put on a circumference of the pelvis of the wearer and configured to be inflated with an inflation gas. The airbag includes: an inner wall that is configured to face the wearer at airbag deployment, the inner wall having a circumferential edge; an outer wall that is configured to face away from the wearer at airbag deployment, the outer wall having a circumferential edge jointed with the circumferential edge of the inner wall so that the airbag has a substantially board shape when inflated; a contact portion that is disposed in a vicinity of an upper end of the airbag as deployed and configured to be deployed at least at a side of the pelvis; and at least one protecting portion that is configured to be deployed in such a manner as to extend downward from the contact portion for covering an outer side of the trochanter of femur of the wearer at airbag deployment. The airbag has a folded form that has a reduced width in an up and down direction compared to that of the airbag in an unfolded state in which the inner wall and outer wall are laid flat one over another. The folded form of the airbag is so configured as to allow the contact portion to be inflated prior to the protecting portion, and to push and deploy the protecting portion downward in an initial stage of airbag deployment.

In the wearable airbag device configured as described above, the airbag is configured so that the contact portion is inflated first and the contact portion as inflated pushes and deploys the protecting portion downward. This configuration will help deploy the protecting portion in a manner prevented from floating away from the wearer, in other words, in proximity to the object of protection, the trochanter of femur. Therefore, the protecting portion will be able to cover the outer side of the trochanter of femur as the object of protection quickly and adequately.

Therefore, the wearable airbag device in accordance with the above exemplary embodiment is able to protect the hip of the wearer in a steady fashion.

In one or more embodiments, the contact portion may be folded in a concertina fashion while the protecting portion is rolled from the lower edge. This configuration will help inflate the contact portion quickly so that the protecting portion will unfold and be deployed downward quickly.

In one or more embodiments, the protecting portion may be rolled on the inner wall from the lower edge. With this configuration, the protecting portion will unroll along the body of the wearer when unrolling, thus will be prevented from floating away from the body of the wearer further adequately.

In one or more embodiments, the wearable airbag device may be configured such that: the airbag further includes a communication portion that provides gas communication between the protecting portion and the contact portion; the protecting portion is configured to have a greater width in a front and rear direction than the communication portion when fully inflated; and the protecting portion has such a folded form that was formed through a front-rear contracting folding that folds and reduces a width in a front and rear direction of the protecting portion, and an up-down contracting folding that folds and reduces a width in the up and down direction of the protecting portion after the front-rear contracting folding.

At deployment of the airbag configured as described above, the contact portion will be inflated first and push the protecting portion downward, then the protecting portion will be inflated while unfolding in the up and down direction (that is, the folds that were formed in the up-down contracting folding unfold) first, then unfolding in the front and rear direction (that is, the folds that were formed in the front-rear contracting folding unfold). Thus the protecting portion will cover the outer side of the trochanter of femur (i.e. the object of protection) quickly and amply in the up and down direction. The protecting portion will also be prevented from being displaced with respect to the trochanter TP of femur in the front and rear direction. Moreover, in the wearable airbag device configured as described above, the protecting portion is reduced in width in the front and rear direction by folding. This configuration will avoid bulkiness.

In one or more embodiments, the wearable airbag device may further include an outer cover that covers an outer circumference of the airbag, the outer cover including an inner wall that is adapted to face the wearer when worn and an outer wall that is adapted to face away from the wearer when worn. The outer cover will prevent the airbag from being deployed toward a direction apart from the wearer and guide the airbag downward. The outer cover will also improve an appearance of the wearable airbag device.

In one or more embodiments, the outer cover may be configured such that a lower end portion of the inner wall and a lower end portion of the outer wall are separably jointed together, and such that the lower end portion of the inner wall and the lower end portion of the outer wall are configured to be separated from one another by the airbag and configured to lead the airbag to deploy downward in the initial stage of airbag deployment. This configuration will prevent foreign matter from entering into the outer cover from below, and also prevent the airbag from floating away from the body of wearer during deployment.

What is claimed is:

1. A wearable airbag device adapted to be worn by a wearer for protecting the hip of the wearer, the airbag device comprising an airbag that is adapted to be put on a circumference of the pelvis of the wearer and configured to be inflated with an inflation gas, the airbag including:

an inner wall that is configured to face the wearer at airbag deployment, the inner wall having a circumferential edge;

an outer wall that is configured to face away from the wearer at airbag deployment, the outer wall having a circumferential edge jointed with the circumferential edge of the inner wall;

a contact portion that is disposed in a vicinity of an upper end of the airbag as deployed and configured to be deployed at least at a side of the pelvis; and at least one protecting portion that is configured to be deployed in such a manner as to extend downward from the contact portion for covering an outer side of the trochanter of femur of the wearer at airbag deployment, wherein the airbag has a folded form that has a reduced width in an up and down direction compared to that of the airbag in an unfolded state in which the inner wall and outer wall are laid flat one over another;

wherein the folded form of the airbag is configured to allow the contact portion to be inflated prior to the protecting portion, wherein the wearable airbag device further comprises an outer cover that covers an outer circumference of the airbag, such that at an initial stage of airbag deployment, the outer cover pushes the contact portion, thereby causing the contact portion to deploy downward, and the contact portion pushes the protection portion, thereby causing the protection portion to deploy downward; and wherein at airbag deployment, an upper end side of the contact portion is covered by the outer cover entirely.

2. The wearable airbag device of claim 1, wherein the contact portion comprises a plurality of creases, each crease extending in the left and right direction of the wearer as viewed from the front, the contact portion is folded, along with a gas-feeding path, in a concertina fashion on the plurality of creases, the protecting portion is rolled from a lower edge thereof, at the initial stage of airbag deployment, the contact portion is inflated, through the gas-feeding path, prior to the protecting portion, and the contact portion unfolds and pushes the protecting portion, thereby causing the protecting portion to unroll downward.

3. The wearable airbag device of claim 2, wherein the protecting portion is rolled up along the inner wall.

4. The wearable airbag device of claim 1, wherein the airbag further includes a communication portion that provides gas communication between the protecting portion and the contact portion;

the protecting portion is configured to have a greater width in a front and rear direction than the communication portion when fully inflated; and the protecting portion has such a folded form that was formed through a front-rear contracting folding that folds and reduces a width in a front and rear direction of the protecting portion, and an up-down contracting folding that folds and reduces a width in the up and down direction of the protecting portion after the front-rear contracting folding.

5. The wearable airbag device of claim 1, wherein the outer cover includes an inner wall that is adapted to face the wearer when worn and an outer wall that is adapted to face away from the wearer when worn.

6. The wearable airbag device of claim 5, wherein a lower end portion of the inner wall of the outer cover and a lower end portion of the outer wall of the outer cover are separably jointed together; and the lower end portion of the inner wall of the outer cover and the lower end portion of the outer wall of the outer cover are configured to be separated from one another by the airbag and configured to lead the airbag to deploy downward in the initial stage of airbag deployment.

7. The wearable airbag device of claim 1, wherein the airbag includes two bag bodies that are configured to cover the hip on left and right sides of the wearer, respectively, and a gas-feeding path that is configured to provide gas communication between the bag bodies at vicinities of upper end portions of the bag bodies; and a first of the two bag bodies includes the contact portion and the protecting portion, and a second of the two bag bodies includes another contact portion and another protection portion, equivalent to the contact portion and the protection portion, respectively.

8. The wearable airbag device of claim 1, wherein an outer shape of the outer cover as laid flat is greater than the airbag as laid flat.

* * * * *